US010331062B2

(12) United States Patent
Yoshinaga et al.

(10) Patent No.: US 10,331,062 B2
(45) Date of Patent: Jun. 25, 2019

(54) IMAGE FORMING APPARATUS AND IMAGE FORMING METHOD

(71) Applicants: Hiroshi Yoshinaga, Chiba (JP); Kenji Ishii, Kanagawa (JP); Hiroyuki Shimada, Tokyo (JP); Ippei Fujimoto, Kanagawa (JP); Takashi Seto, Kanagawa (JP); Takayuki Seki, Kanagawa (JP); Kazunari Sawada, Shizuoka (JP)

(72) Inventors: Hiroshi Yoshinaga, Chiba (JP); Kenji Ishii, Kanagawa (JP); Hiroyuki Shimada, Tokyo (JP); Ippei Fujimoto, Kanagawa (JP); Takashi Seto, Kanagawa (JP); Takayuki Seki, Kanagawa (JP); Kazunari Sawada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/783,199

(22) Filed: Oct. 13, 2017

(65) Prior Publication Data

US 2018/0120741 A1 May 3, 2018

(30) Foreign Application Priority Data

Oct. 27, 2016 (JP) ..... 2016-210472
Feb. 9, 2017 (JP) ..... 2017-022061

(51) Int. Cl.
*G03G 15/20* (2006.01)
*G03G 15/00* (2006.01)

(52) U.S. Cl.
CPC ..... *G03G 15/2039* (2013.01); *G03G 15/2017* (2013.01); *G03G 15/55* (2013.01)

(58) Field of Classification Search
CPC ..... G03G 15/5012; G03G 15/70; G03G 2215/00548; G03G 2215/00552; G03G 2221/1675
See application file for complete search history.

(56) References Cited

U.S. PATENT DOCUMENTS 4,139,300 A * 2/1979 Katayama ..... G03G 21/145 399/128
2011/0052237 A1 3/2011 Yoshikawa et al.
(Continued)

FOREIGN PATENT DOCUMENTS

JP 2010-032631 2/2010
JP 2013-178487 9/2013

*Primary Examiner* — Sevan A Aydin
(74) *Attorney, Agent, or Firm* — Oblon, McClelland, Maier & Neustadt, L.L.P.

(57) ABSTRACT

An image forming apparatus includes a fixing device that includes a heater to heat a fixing rotator, an opposed rotator to press against the fixing rotator to form a fixing nip therebetween, and at least one rotary body to convey a recording medium to the fixing nip. A controller rotates the fixing rotator in a forward direction to fix a toner image on the recording medium. The controller stops the heater and rotates the fixing rotator in a predetermined rotation direction when a failure occurs while the fixing device is activated. The controller determines that the predetermined rotation direction is the forward direction or a backward direction according to the at least one rotary body that sandwiches the recording medium, if the fixing nip and the at least one rotary body sandwich the recording medium simultaneously when the failure occurs while the fixing device is activated.

15 Claims, 16 Drawing Sheets

(56) References Cited

U.S. PATENT DOCUMENTS

| | | | | |
|---|---|---|---|---|
| 2012/0301161 | A1 | 11/2012 | Fujimoto | |
| 2013/0195477 | A1 | 8/2013 | Seshita et al. | |
| 2013/0195493 | A1 | 8/2013 | Hase et al. | |
| 2013/0209121 | A1 | 8/2013 | Uchitani et al. | |
| 2014/0270820 | A1 | 9/2014 | Saito et al. | |
| 2014/0270831 | A1 | 9/2014 | Yoshinaga et al. | |
| 2014/0356036 | A1 | 12/2014 | Shimokawa et al. | |
| 2014/0356037 | A1 | 12/2014 | Shimokawa et al. | |
| 2015/0234329 | A1 | 8/2015 | Hase et al. | |
| 2015/0309465 | A1* | 10/2015 | Matsumoto | G03G 15/70 399/21 |
| 2016/0060057 | A1* | 3/2016 | Nobuta | H02P 29/0241 74/405 |
| 2016/0098003 | A1 | 4/2016 | Uchitani et al. | |
| 2016/0274510 | A1 | 9/2016 | Hase et al. | |
| 2016/0274514 | A1 | 9/2016 | Ishii et al. | |

* cited by examiner

IMAGE FORMING APPARATUS AND IMAGE FORMING METHOD

CROSS-REFERENCE TO RELATED APPLICATIONS

This patent application is based on and claims priority pursuant to 35 U.S.C. § 119 to Japanese Patent Application Nos. 2016-210472, filed on Oct. 27, 2016, and 2017-022061, filed on Feb. 9, 2017, in the Japanese Patent Office, the entire disclosure of each of which is hereby incorporated by reference herein.

BACKGROUND

Technical Field

Exemplary aspects of the present disclosure relate to an image forming apparatus and an image forming method, and more particularly, to an image forming apparatus for forming a toner image on a recording medium and an image forming method performed by the image forming apparatus.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved image forming apparatus. In one embodiment, the image forming apparatus includes a fixing device to fix a toner image on a recording medium. The fixing device includes a fixing rotator being rotatable in a forward direction and a backward direction opposite the forward direction. A heater heats the fixing rotator. An opposed rotator presses against an outer circumferential surface of the fixing rotator to form a fixing nip between the fixing rotator and the opposed rotator, through which the recording medium bearing the toner image is conveyed. At least one rotary body conveys the recording medium to the fixing nip. A controller rotates the fixing rotator in the forward direction to fix the toner image on the recording medium. The controller stops the heater and rotates the fixing rotator in a predetermined rotation direction when a failure occurs while the fixing device is activated. The controller determines that the predetermined rotation direction of the fixing rotator is one of the forward direction and the backward direction according to the at least one rotary body that sandwiches the recording medium, if the fixing rotator and the opposed rotator at the fixing nip and the at least one rotary body sandwich the recording medium simultaneously when the failure occurs while the fixing device is activated.

This specification further describes an improved image forming method. In one embodiment, the image forming method includes detecting that a recording medium is jammed; turning off a heater; starting rotating a fixing rotator at a decreased linear velocity; measuring a fixing rotator driving load imposed on the fixing rotator; determining that the fixing rotator driving load is a predetermined value or greater; braking a fixing motor; interrupting driving of the fixing rotator; and rotating the fixing rotator in a backward direction.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
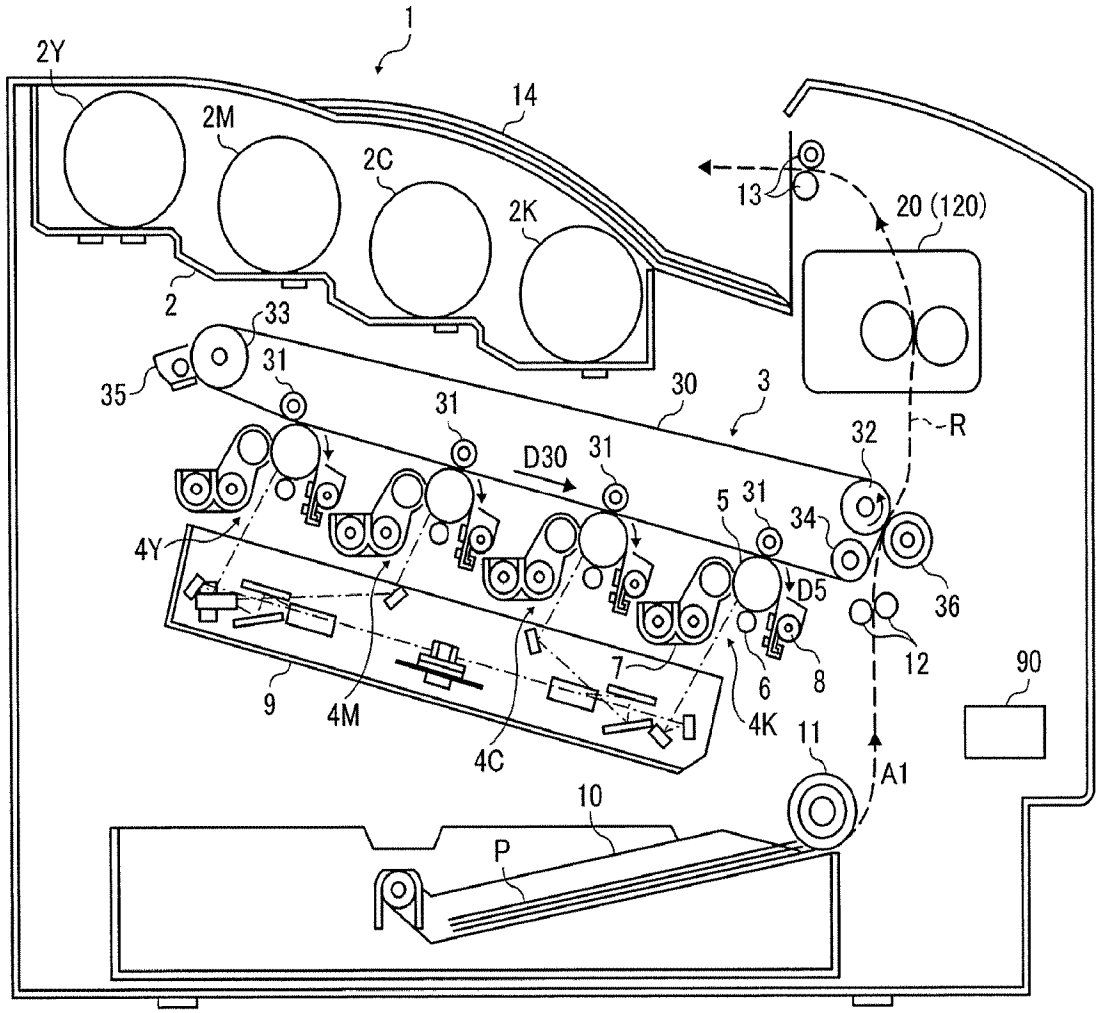
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this embodiment, the image forming apparatus 1 is a color printer that forms a color toner image on a recording medium by electrophotography. Alternatively, the image forming apparatus 1 may be a monochrome printer that forms a monochrome toner image on a recording medium.

Referring to FIG. 1, a description is provided of a construction of the image forming apparatus 1.

In the drawings for explaining embodiments of this disclosure, identical reference numerals are assigned as long as discrimination is possible to components such as members and component parts having an identical function or shape, thus omitting description thereof once it is provided.

As illustrated in FIG. 1, the image forming apparatus 1 is a color laser printer. Four image forming devices 4Y, 4M, 4C, and 4K are disposed in a center portion of the image forming apparatus 1. Although the image forming devices 4Y, 4M, 4C, and 4K contain developers (e.g., yellow, magenta, cyan, and black toners) in different colors, that is, yellow, magenta, cyan, and black corresponding to color separation components of a color image, respectively, the image forming devices 4Y, 4M, 4C, and 4K have an identical structure.

For example, each of the image forming devices 4Y, 4M, 4C, and 4K includes a drum-shaped photoconductor 5 serving as a latent image bearer or an image bearer that bears an electrostatic latent image and a resultant toner image and a charger 6 that charges an outer circumferential surface of the photoconductor 5. Each of the image forming devices 4Y, 4M, 4C, and 4K further includes a developing device 7 that supplies toner to the electrostatic latent image formed on the outer circumferential surface of the photoconductor 5, thus visualizing the electrostatic latent image as a toner image and a cleaner 8 that cleans the outer circumferential surface of the photoconductor 5. FIG. 1 illustrates reference numerals assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, and a secondary transfer roller 36 serving as a secondary transferor. The transfer device 3 further includes a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply. The power supply applies at least one of a predetermined direct current (DC) voltage and a predetermined alternating current (AC) voltage to each of the primary transfer rollers 31.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply that applies at least one of a predetermined direct current (DC) voltage and a predetermined alternating current (AC) voltage thereto.

The belt cleaner 35 includes a cleaning brush and a cleaning blade that contact an outer circumferential surface of the intermediate transfer belt 30. A waste toner drain tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached to the bottle holder 2. The toner bottles 2Y, 2M, 2C, and 2K contain fresh yellow, magenta, cyan, and black toners to be supplied to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 serving as a sheet tray that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like, rather than plain paper, may be attached to the image forming apparatus 1.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a timing roller pair 12 (e.g., a registration roller pair) disposed upstream from the secondary transfer nip formed between the secondary transfer roller 36 and the intermediate transfer belt 30 in a recording medium conveyance direction A1. The timing roller pair 12 conveys the recording medium P conveyed from the feed roller 11 toward the secondary transfer nip at a proper time.

The conveyance path R is further provided with a fixing device 20 disposed downstream from the secondary transfer nip in the recording medium conveyance direction A1. The fixing device 20 fixes an unfixed toner image, which is transferred from the intermediate transfer belt 30 onto the recording medium P, on the recording medium P. The conveyance path R is further provided with the output roller pair 13 disposed downstream from the fixing device 20 in the recording medium conveyance direction A1. The output roller pair 13 ejects the recording medium P bearing the fixed toner image onto the outside of the image forming apparatus 1, that is, an output tray 14 disposed atop the image forming apparatus 1. The output tray 14 stocks the recording medium P ejected by the output roller pair 13.

The image forming apparatus 1 further includes a controller 90 that controls an entire operation of the image forming apparatus 1. The controller 90 controls driving of the components of the image forming apparatus 1 according to a control program stored in the controller 90. The controller 90 may be located inside the image forming apparatus 1 or the fixing device 20.

Referring to FIG. 1, a description is provided of an image forming operation performed by the image forming apparatus 1 having the construction described above to form a full color toner image on a recording medium P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity.

The exposure device 9 emits laser beams onto the charged outer circumferential surface of the respective photoconductors 5 according to yellow, magenta, cyan, and black image data, respectively, thus forming electrostatic latent images on the outer circumferential surface of the photoconductors 5. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at the respective primary transfer nips formed between the photoconductors 5 and the primary transfer rollers 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30.

After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a recording medium P from the paper tray 10 toward the timing roller pair 12 through the conveyance path R. The timing roller pair 12 temporarily halts the recording medium P conveyed through the conveyance path R.

Thereafter, the timing roller pair 12 resumes rotation at a predetermined time to convey the recording medium P to the secondary transfer nip at a time when the full color toner image formed on intermediate transfer belt 30 reaches the secondary transfer nip. The secondary transfer roller 36 is applied with a transfer voltage having a polarity opposite a polarity of the charged yellow, magenta, cyan, and black toners constructing the full color toner image formed on the intermediate transfer belt 30, thus creating a transfer electric field at the secondary transfer nip.

The transfer electric field secondarily transfers the yellow, magenta, cyan, and black toner images constructing the full color toner image formed on the intermediate transfer belt 30 onto the recording medium P collectively. After the secondary transfer of the full color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the full color toner image is conveyed to the fixing device 20 that fixes the full color toner image on the recording medium P. Thereafter, the recording medium P bearing the fixed full color toner image is ejected by the output roller pair 13 onto the outside of the image forming apparatus 1, that is, the output tray 14 that stocks the recording medium P.

The above describes the image forming operation of the image forming apparatus 1 to form the full color toner image on the recording medium P. Alternatively, for example, the image forming apparatus 1 may form a monochrome toner image by using any one of the four image forming devices 4Y, 4M, 4C, and 4K or may form a bicolor toner image or a tricolor toner image by using two or three of the image forming devices 4Y, 4M, 4C, and 4K.

Figure 2:
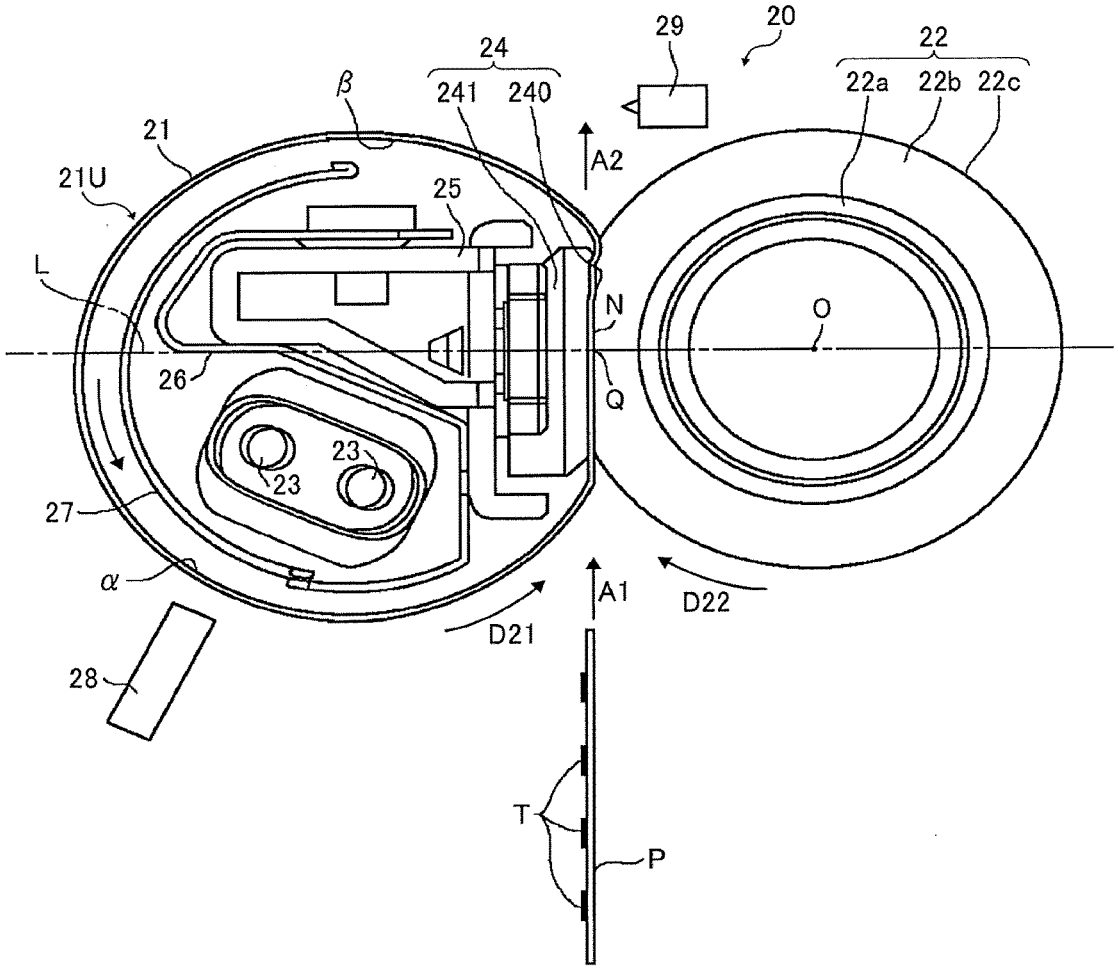
FIG. 2 is a schematic vertical cross-sectional view of a fixing device incorporated in the image forming apparatus depicted in FIG. 1.
Figure 3:
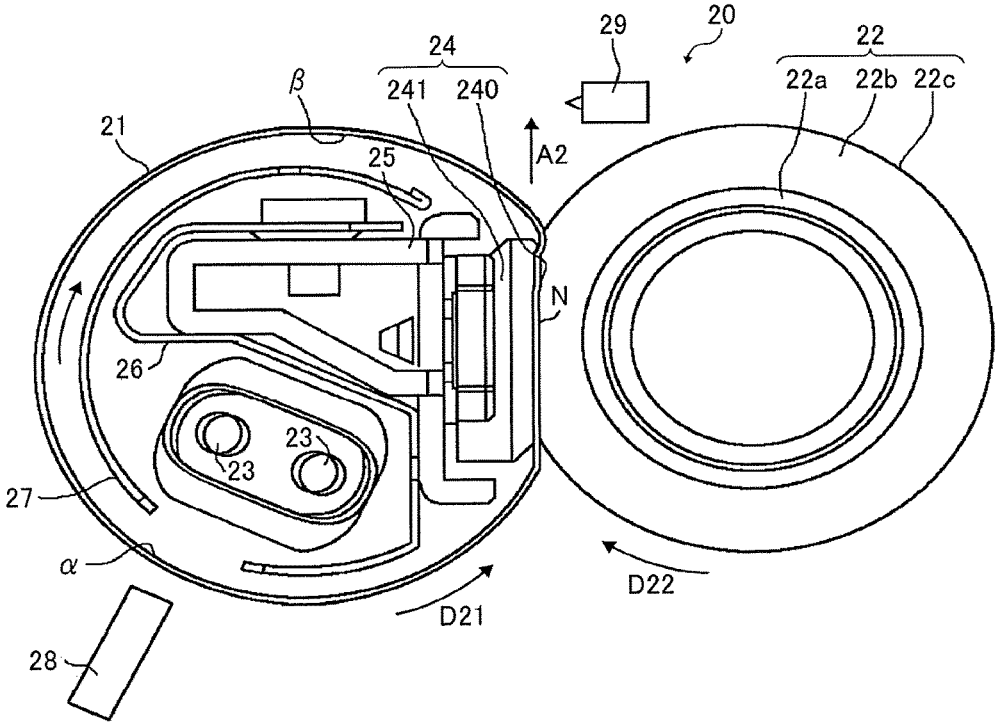
FIG. 3 is a vertical cross-sectional view of the fixing device depicted in FIG. 2, illustrating a non-shield position of a heat shield.

Referring to FIGS. 2 and 3, a description is provided of a construction of the fixing device 20 incorporated in the image forming apparatus 1 described above.

FIG. 2 is a vertical cross-sectional view of the fixing device 20, illustrating a shield position. FIG. 3 is a vertical cross-sectional view of the fixing device 20, illustrating a non-shield position.

As illustrated in FIG. 2, the fixing device 20 (e.g., a fuser or a fusing unit) includes a fixing belt 21, a pressure roller 22, a halogen heater 23, a nip formation pad 24, a stay 25, a reflector 26, a heat shield 27, a temperature sensor 28, and a recording medium sensor 29.

The fixing belt 21 serves as a fixing rotator or a fixing member that is rotatable in a rotation direction D21 and a direction opposite the rotation direction D21. The pressure roller 22 serves as an opposed rotator, an opposed member, or a pressure rotator that is rotatable in a rotation direction D22 and a direction opposite the rotation direction D22. The pressure roller 22 separably or inseparably contacts an outer circumferential surface of the fixing belt 21. The halogen heater 23 serves a heater or a heat source that heats the fixing belt 21. The nip formation pad 24 is disposed opposite an inner circumferential surface of the fixing belt 21 and presses against the pressure roller 22 via the fixing belt 21 to form a fixing nip N. The stay 25 serves as a support that supports the nip formation pad 24. The reflector 26 reflects heat or light radiated from the halogen heater 23 to the fixing belt 21. The temperature sensor 28 serves as a first temperature detector that detects the temperature of the outer circumferential surface of the fixing belt 21. The recording medium sensor 29 serves as a recording medium detector that detects the recording medium P.

The fixing belt 21 and the components disposed inside a loop formed by the fixing belt 21, that is, the halogen heater 23, the nip formation pad 24, the stay 25, the reflector 26, and the heat shield 27, may construct a belt unit 21U separably coupled with the pressure roller 22. The heat shield 27 shields the fixing belt 21 from the halogen heater 23 in a non-conveyance span of the fixing belt 21 where the recording medium P is not conveyed.

A detailed description is now given of a construction of the fixing belt 21.

The fixing belt 21 is a thin, flexible endless belt or film. For example, the fixing belt 21 includes a base layer constructing the inner circumferential surface of the fixing belt 21 and a release layer constructing the outer circumferential surface of the fixing belt 21. The base layer constructing the inner circumferential surface of the fixing belt 21 is made of metal such as nickel and SUS stainless steel or resin such as polyimide (PI). The release layer constructing the outer circumferential surface of the fixing belt 21 is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves a fixing property of being heated quickly.

However, as the pressure roller 22 and the fixing belt 21 sandwich and press an unfixed toner image T on the recording medium P to fix the toner image T on the recording medium P while the recording medium P passes through the fixing nip N, slight surface asperities of the fixing belt 21 may be transferred onto the toner image T on the recording medium P, producing variation in gloss of a solid portion of the toner image T on the recording medium P. To address this circumstance, the fixing belt 21 incorporates the elastic layer having a thickness not smaller than 100 micrometers. The elastic layer having the thickness not smaller than 100 micrometers elastically deforms to absorb slight surface asperities of the fixing belt 21, preventing variation in gloss of the toner image T on the recording medium P.

According to this embodiment, in order to decrease the thermal capacity of the fixing belt 21, the fixing belt 21 is thin and has a decreased loop diameter. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. Thus, the fixing belt 21 has a total thickness not greater than 1 mm.

A loop diameter of the fixing belt 21 is in a range of from 20 mm to 40 mm. In order to decrease the thermal capacity of the fixing belt 21 further, the fixing belt 21 may have a total thickness not greater than 0.20 mm and preferably not greater than 0.16 mm. Additionally, the loop diameter of the fixing belt 21 may not be greater than 30 mm.

A detailed description is now given of a construction of the pressure roller 22.

The pressure roller 22 is constructed of a core bar 22*a*; an elastic layer 22*b* coating the core bar 22*a* and made of silicone rubber foam, silicone rubber, fluoro rubber, or the like; and a release layer 22*c* coating the elastic layer 22*b* and made of PFA, PTFE, or the like. A switcher 60 described below presses the pressure roller 22 against the nip formation pad 24 via the fixing belt 21, bringing the pressure roller 22 into contact with the fixing belt 21.

The pressure roller 22 pressingly contacting the fixing belt 21 deforms the elastic layer 22*b* of the pressure roller 22 at the fixing nip N formed between the pressure roller 22 and the fixing belt 21, thus defining the fixing nip N having a predetermined length in the recording medium conveyance direction A1. According to this embodiment, the pressure roller 22 is pressed against the fixing belt 21. Alternatively, the pressure roller 22 may merely contact the fixing belt 21 with no pressure therebetween.

A driver (e.g., a fixing motor 50 described below) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the pressure roller 22 and the fixing belt 21. Alternatively, the driver may also be connected to the fixing belt 21 to drive and rotate the fixing belt 21.

According to this embodiment, the pressure roller 22 is a solid roller. Alternatively, the pressure roller 22 may be a hollow roller. In this case, a heater such as a halogen heater may be disposed inside the hollow roller. The elastic layer 22*b* may be made of solid rubber. Alternatively, if no heater is situated inside the pressure roller 22, the elastic layer 22*b* may be made of sponge rubber. The sponge rubber is more preferable than the solid rubber because the sponge rubber has an increased insulation that draws less heat from the fixing belt 21.

A detailed description is now given of a configuration of the halogen heater 23.

The halogen heater 23 is disposed opposite the inner circumferential surface of the fixing belt 21 and upstream from the fixing nip N in the recording medium conveyance direction A1. For example, a hypothetical line L is defined by a center Q of the fixing nip N in the recording medium conveyance direction A1 and a rotation axis O of the pressure roller 22. The halogen heater 23 is disposed upstream from the hypothetical line L in the recording medium conveyance direction A1, that is, below the hypothetical line L in FIG. 2.

The power supply situated inside the image forming apparatus 1 supplies power to the halogen heater 23 so that the halogen heater 23 generates heat. The controller 90 (e.g., a processor), that is, a central processing unit (CPU) provided with a random-access memory (RAM) and a read-only memory (ROM), for example, operatively connected to the halogen heater 23 and the temperature sensor 28 controls the halogen heater 23 based on the temperature of the outer circumferential surface of the fixing belt 21 that is detected by the temperature sensor 28. Thus, the temperature of the fixing belt 21 is adjusted to a desired fixing temperature.

Instead of the temperature sensor 28 that detects the temperature of the fixing belt 21, a temperature sensor that detects the temperature of the pressure roller 22 may be disposed opposite the pressure roller 22 so that the temperature of the fixing belt 21 is estimated based on a temperature of the pressure roller 22 that is detected by the temperature sensor.

According to this embodiment, the fixing device 20 includes two halogen heaters 23. Alternatively, the fixing device 20 may include one halogen heater 23 or three or more halogen heaters 23 according to the size of the recording medium P or the like available in the image forming apparatus 1. Alternatively, instead of the halogen heater 23, an induction heater (IH), a resistive heat generator, a carbon heater, or the like may be employed as a heater that heats the fixing belt 21.

A detailed description is now given of a construction of the nip formation pad 24.

The nip formation pad 24 includes a base pad 241 and a low-friction slide sheet 240 disposed on an opposed face of the base pad 241 disposed opposite the fixing belt 21. The base pad 241 extends in a longitudinal direction thereof parallel to an axial direction of the fixing belt 21 or the pressure roller 22.

As the base pad 241 is exerted with pressure from the pressure roller 22, the base pad 241 defines the shape of the fixing nip N. According to this embodiment, the fixing nip N is planar. Alternatively, the fixing nip N may define a recess, a curve, or other shapes.

As the fixing belt 21 rotating in the rotation direction D21 slides over the base pad 241, the slide sheet 240 decreases friction between the fixing belt 21 and the base pad 241. If the base pad 241 is made of a low-friction material, the slide sheet 240 may not be interposed between the fixing belt 21 and the base pad 241.

The base pad 241 is made of a heat resistant material resistant against temperatures of about 200 degrees centigrade. Thus, the nip formation pad 24 is immune from thermal deformation at temperatures in a fixing temperature range desirable to fix the toner image T on the recording medium P, retaining the shape of the fixing nip N and quality of the toner image T formed on the recording medium P.

Additionally, the base pad 241 is made of a rigid material to secure the mechanical strength of the nip formation pad 24. For example, the base pad 241 is made of resin such as polyether sulfone (PES), polyphenylene sulfide (PPS), liquid crystal polymer (LCP), polyether nitrile (PEN), polyamide imide (PAI), and polyether ether ketone (PEEK). Alternatively, the base pad 241 may be made of metal or ceramics.

The base pad 241 is mounted on and supported by the stay 25. Accordingly, even if the nip formation pad 24 receives pressure from the pressure roller 22, the nip formation pad 24 is not bent by the pressure and therefore produces a uniform nip length in the recording medium conveyance direction A1 throughout the entire width of the pressure roller 22 in the axial direction thereof. The stay 25 is made of metal having an increased mechanical strength, such as stainless steel and iron, to prevent bending of the nip formation pad 24.

A detailed description is now given of a configuration of the reflector 26.

The reflector 26 is secured to and supported by the stay 25 such that the reflector 26 is disposed opposite the halogen heater 23. The reflector 26 reflects radiant heat or light radiated from the halogen heater 23 toward the fixing belt 21, suppressing conduction of heat from the halogen heater 23 to the stay 25 and the like and thereby heating the fixing belt 21 effectively and saving energy. The reflector 26 is made of aluminum, stainless steel, or the like. If the reflector 26 is constructed of an aluminum base treated with vapor deposition of silver having a decreased emissivity and an increased reflectance, the reflector 26 enhances heating efficiency in heating the fixing belt 21.

A detailed description is now given of a configuration of the heat shield 27.

The heat shield 27 is manufactured by contouring a metal plate having a thickness in a range of from 0.1 mm to 1.0 mm into an arch in cross-section along the inner circumferential surface of the fixing belt 21. The heat shield 27 is interposed between the halogen heater 23 and the fixing belt 21 and movable in a circumferential direction of the fixing belt 21.

According to this embodiment, as illustrated in FIGS. 2 and 3, the fixing belt 21 has a circumferential heated span α and a circumferential non-heated span β spanning in the circumferential direction thereof. The circumferential heated span α is heated directly by the halogen heater 23. The circumferential non-heated span β is not heated by the halogen heater 23 directly. The circumferential heated span α is disposed opposite a front of the halogen heater 23 directly. The circumferential non-heated span β is disposed opposite components (e.g., the reflector 26, the stay 25, and the nip formation pad 24) interposed between the halogen heater 23 and the fixing belt 21 and secured to side plates or the like and therefore is not heated by the halogen heater 23 directly.

As illustrated in FIG. 2, when the heat shield 27 is requested to shield the fixing belt 21 from the halogen heater 23, the heat shield 27 selectively moves to one or more shield positions where the heat shield 27 is disposed opposite the circumferential heated span α of the fixing belt 21. Conversely, as illustrated in FIG. 3, when the heat shield 27 is not requested to shield the fixing belt 21 from the halogen heater 23, the heat shield 27 moves to the non-shield position where the heat shield 27 is disposed opposite the circumferential non-heated span β of the fixing belt 21. Thus, the entire heat shield 27 is retracted to the non-shield position where the heat shield 27 is situated behind the reflector 26 and the stay 25.

As the heat shield 27 rotates, the heat shield 27 changes the area of the circumferential heated span α of the fixing belt 21, adjusting an amount of radiant heat radiated from the halogen heater 23 to the fixing belt 21. Since the heat shield 27 is requested to be heat resistant, the heat shield 27 is made of metal such as aluminum, iron, and stainless steel or ceramics.

A detailed description is now given of a configuration of the recording medium sensor 29.

The recording medium sensor 29 is disposed downstream from the fixing nip N in a recording medium conveyance direction A2. The recording medium sensor 29 detects the recording medium P as the recording medium P passes over the recording medium sensor 29. For example, the recording medium sensor 29 is a photointerrupter or the like.

A description is provided of a configuration of a plurality of flanges 40.

Figure 4:
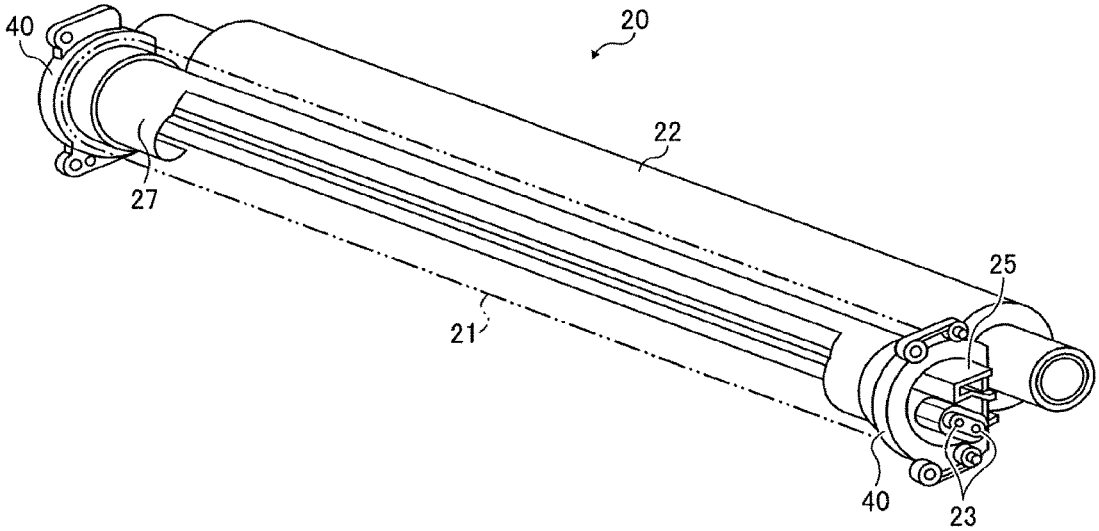
FIG. 4 is a perspective view of the fixing device, illustrating the heat shield situated at the non-shield position depicted in FIG. 3.

FIG. 4 is a perspective view of the fixing device 20, illustrating the heat shield 27 situated at the non-shield position depicted in FIG. 3. As illustrated in FIG. 4, the fixing device 20 further includes the plurality of flanges 40 serving as a plurality of belt holders disposed opposite the inner circumferential surface of the fixing belt 21 at both lateral ends of the fixing belt 21 in the axial direction thereof, respectively. The flanges 40 are inserted into both lateral ends of the fixing belt 21 in the axial direction thereof, respectively, to rotatably support the fixing belt 21. The flanges 40, the halogen heater 23, and the stay 25 are secured to and supported by the pair of side plates of the fixing device 20.

A description is provided of a support mechanism of the fixing device 20, which supports the heat shield 27.

Figure 5:
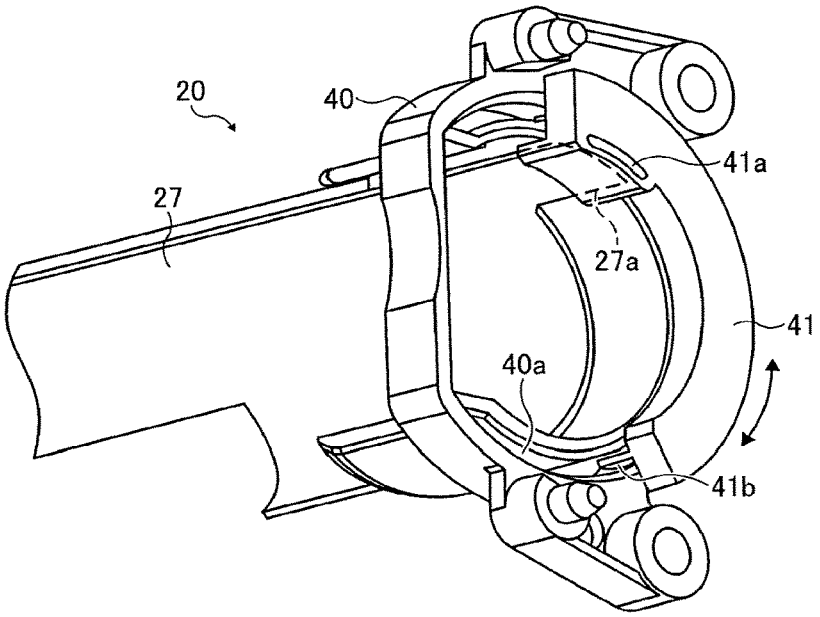
FIG. 5 is a partial perspective view of the fixing device depicted in FIG. 4, illustrating a support mechanism that supports the heat shield.

FIG. 5 is a partial perspective view of the fixing device 20, illustrating the support mechanism that supports the heat shield 27 situated at the non-shield position depicted in FIG. 3. As illustrated in FIG. 5, the heat shield 27 is supported by the flange 40 through a slider 41 that is mounted on the flange 40 and arch-shaped.

For example, the heat shield 27 includes a projection 27*a* disposed at a lateral end of the heat shield 27 in a longitudinal direction thereof. The slider 41 includes a slit 41*a*. As the projection 27*a* is inserted into the slit 41*a*, the heat shield 27 is coupled with the slider 41. The slider 41 further includes a projection 41*b*. The flange 40 includes a groove 40*a* that is arch-shaped. As the projection 41*b* is inserted into the groove 40*a*, the slider 41 moves and slides along the groove 40*a*.

Hence, the heat shield 27 is pivotally movable in a circumferential direction of the flange 40 together with the slider 41. According to this embodiment, each of the flange 40 and the slider 41 is made of resin.

FIG. 5 illustrates the support mechanism disposed at one lateral end of the heat shield 27 in the longitudinal direction thereof. Similarly, at another lateral end of the heat shield 27 in the longitudinal direction thereof, the heat shield 27 is pivotally supported by the flange 40 through the slider 41.

A description is provided of a driving mechanism of the fixing device 20, which drives the heat shield 27.

Figure 6:
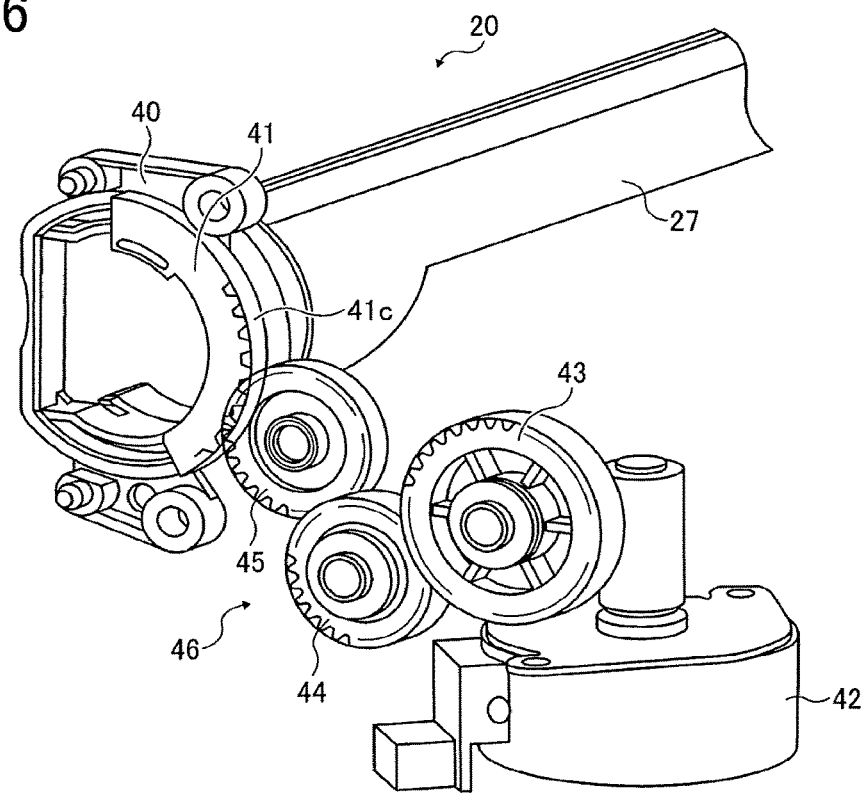
FIG. 6 is a partial perspective view of the fixing device depicted in FIG. 4, illustrating a driving mechanism that drives the heat shield.

FIG. 6 is a partial perspective view of the fixing device 20, illustrating the driving mechanism that drives the heat shield 27 situated at the non-shield position depicted in FIG. 3. As illustrated in FIG. 6, the driving mechanism that drives the heat shield 27 includes a motor 42 serving as a driving source and a driving force transmitter 46 including a gear train constructed of a plurality of gears 43, 44, and 45.

The gear 43 situated at one end of the gear train is coupled to the motor 42. The gear 45 situated at another end of the gear train meshes with a gear portion 41*c* mounted on the slider 41 in a circumferential direction thereof. As the motor 42 is driven, a driving force generated by the motor 42 is transmitted to the slider 41 through the gear train. Accordingly, the heat shield 27 pivots in a forward direction in which the heat shield 27 moves from the circumferential non-heated span β to the circumferential heated span α and a backward direction in which the heat shield 27 moves from the circumferential heated span α to the circumferential non-heated span β. For example, the motor 42 is a stepping motor. In this case, the controller 90 controls the position of the heat shield 27 by changing the number of driving pulses. Alternatively, instead of the stepping motor, the motor 42 may be a direct current (DC) motor or the like.

The temperature sensor 28 depicted in FIG. 2 or the like detects the temperature of the fixing belt 21 at a center and a lateral end of the fixing belt 21 in the axial direction thereof. The controller 90 controls the heat shield 27 to change a shield span where the heat shield 27 shields the fixing belt 21 from the halogen heater 23 according to a detected temperature of the fixing belt 21 or a temperature differential between a temperature of the center of the fixing belt 21 and a temperature of the lateral end of the fixing belt 21. A detailed description of motion of the heat shield 27 is omitted.

A description is provided of a construction of the switcher 60 that moves the pressure roller 22 between a pressurization position and a depressurization position at the fixing nip N.

Figure 7A:
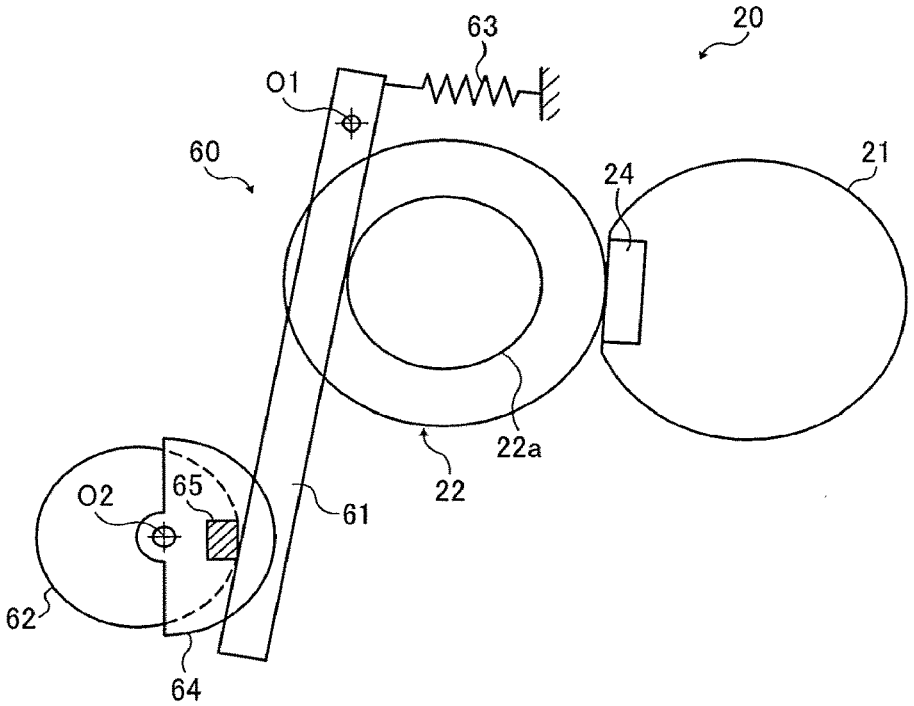
FIG. 7A is a schematic vertical cross-sectional view of the fixing device depicted in FIG. 3, illustrating a switcher that places a pressure roller at a depressurization position.
Figure 7B:
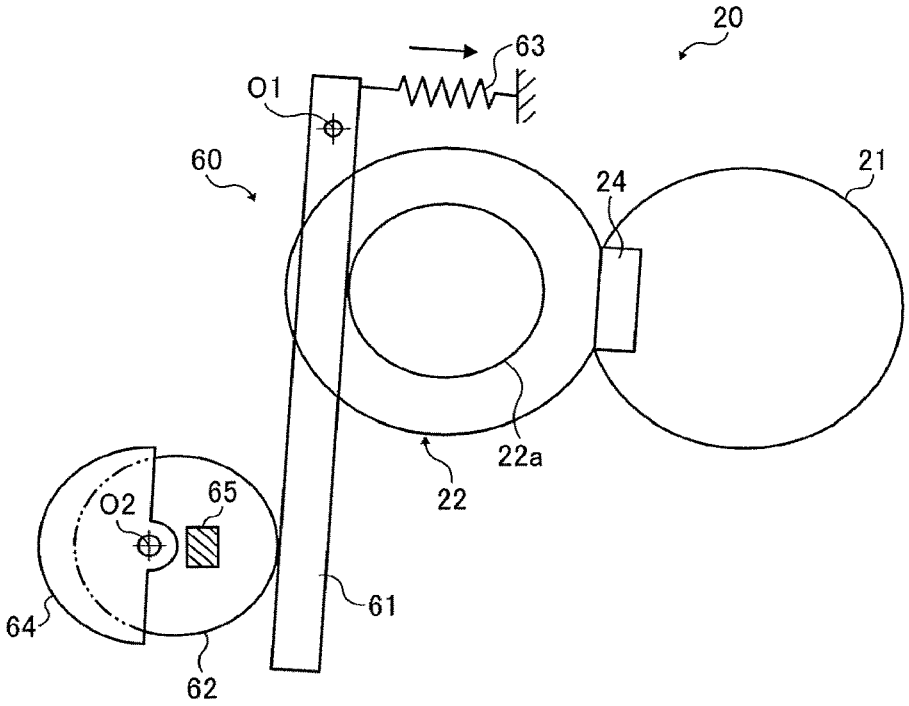
FIG. 7B is a schematic vertical cross-sectional view of the fixing device depicted in FIG. 3, illustrating the switcher that places the pressure roller at a pressurization position.

FIG. 7A is a schematic vertical cross-sectional view of the fixing device 20, illustrating the switcher 60 that places the pressure roller 22 at the depressurization position. FIG. 7B is a schematic vertical cross-sectional view of the fixing device 20, illustrating the switcher 60 that places the pressure roller 22 at the pressurization position. The switcher 60 switches pressure exerted by the pressure roller 22 to the fixing belt 21 at the fixing nip N. As the switcher 60 presses the pressure roller 22 against the fixing belt 21, the pressure roller 22 is at the pressurization position where the pressure roller 22 exerts pressure to the fixing belt 21 at the fixing nip N. Conversely, as the switcher 60 separates the pressure roller 22 from the fixing belt 21, the pressure roller 22 is at the depressurization position where the pressure roller 22 releases pressure exerted to the fixing belt 21 at the fixing nip N.

The switcher 60 also detects where the pressure roller 22 is at the fixing nip N, the pressurization position or the depressurization position. The switcher 60 includes a lever 61, a cam 62, a resilient member 63, a feeler 64 serving as a detected member, and a sensor 65 serving as a detector as main components.

The lever 61 is supported by a shaft O1 disposed at one end of the lever 61 in a longitudinal direction thereof such that the lever 61 is pivotable about the shaft O1. A cam face (e.g., an outer circumferential face) of the cam 62 contacts another end of the lever 61 in the longitudinal direction thereof. The core bar 22*a* exposed at each lateral end of the pressure roller 22 in the axial direction thereof contacts an intermediate portion of the lever 61 in the longitudinal direction thereof.

The cam 62 is supported by a shaft O2 that is eccentrically disposed such that the cam 62 is pivotable about the shaft O2. A motor (e.g., a pressurization-depressurization motor) or the like that serves as a driver drives and rotates the cam 62. The resilient member 63 (e.g., a tension spring) generates a resilient force that presses the lever 61 against the cam face of the cam 62.

The pressure roller 22 is supported such that the pressure roller 22 slides horizontally in FIGS. 7A and 7B to come into contact with and separate from the fixing belt 21. As illustrated in FIG. 7A, when the shaft O2 of the cam 62 is nearest to the lever 61 and the cam face defining a shortest diameter of the cam 62 from the shaft O2 contacts the lever 61, the resilient force generated by the resilient member 63 biases the lever 61 in a separation direction in which the lever 61 separates from the core bar 22*a* of the pressure roller 22.

Accordingly, the pressure roller 22 separates from the fixing belt 21, releasing pressure exerted to the fixing belt 21 at the fixing nip N. Conversely, as illustrated in FIG. 7B, when the shaft O2 of the cam 62 is farthest from the lever 61 and the cam face defining a greatest diameter of the cam 62 from the shaft O2 contacts the lever 61, the lever 61 presses the core bar 22*a* of the pressure roller 22 toward the fixing belt 21 with pressure received from the cam 62. Thus, the pressure roller 22 exerts pressure to the fixing belt 21 at the fixing nip N.

Figure 8:
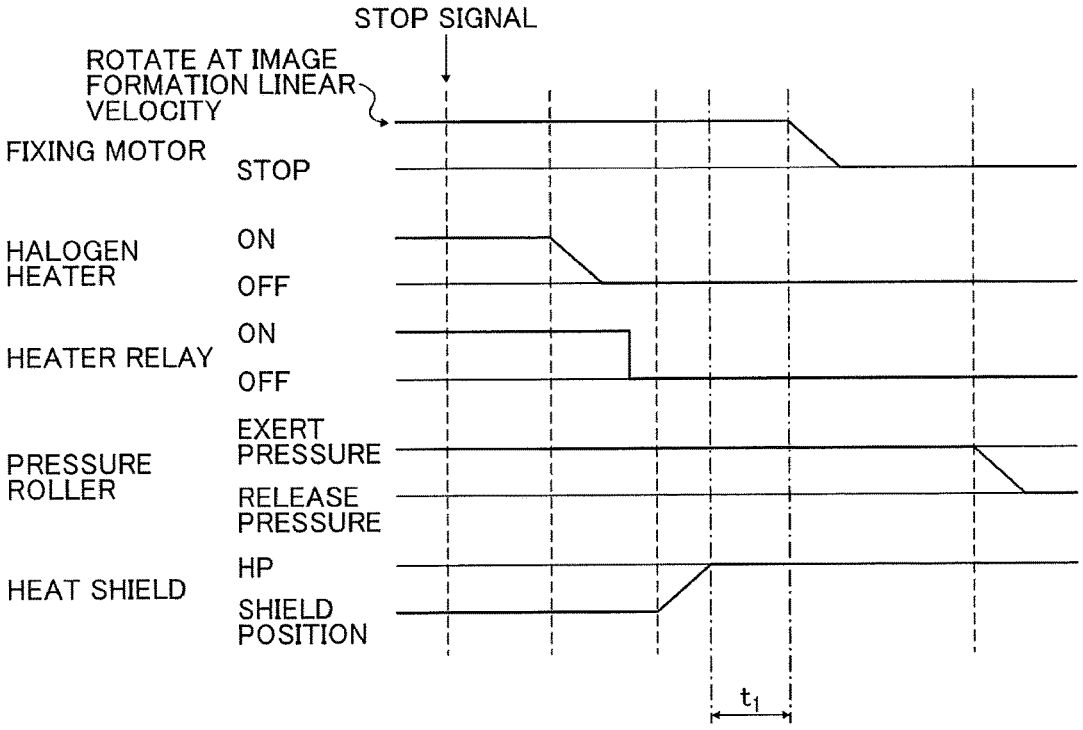
FIG. 8 is a timing chart illustrating a sequence of driving times of components of the fixing device depicted in FIG. 3 after a print job finishes normally.

Referring to FIG. 8, a description is provided of a sequence of driving times of the components of the fixing device 20 after a print job finishes normally.

FIG. 8 is a timing chart illustrating the sequence of the driving times of the components of the fixing device 20 after the print job finishes normally.

The controller 90 of the image forming apparatus 1 depicted in FIG. 1 sends a stop signal to the fixing device 20 at a time when a trailing edge of a last recording medium P of a print job is ejected from the fixing nip N. After the fixing device 20 receives the stop signal, the halogen heater 23 is turned off. Subsequently, a heater relay is turned off. Thereafter, if the fixing device 20 incorporates the heat shield 27, the heat shield 27 returns to a default position, that is, a home position (HP).

Although the fixing belt 21 continues rotating, when a predetermined time t1 elapses after the heat shield 27 returns to the default position, the controller 90 stops the fixing motor 50. After the fixing motor 50 stops, the switcher 60 depicted in FIGS. 7A and 7B causes the pressure roller 22 to release pressure exerted to the fixing belt 21 at the fixing nip N.

The fixing belt 21 continues rotating for the predetermined time t1 after the heat shield 27 returns to the default position to prevent the fixing belt 21 from being heated locally with residual heat and therefore prevent the fixing belt 21 from suffering from temperature deviation. The time t1 is set by estimating a time taken to even an amount of heat stored in the fixing belt 21. For example, end of the time t1 is determined based on the temperature of the fixing belt 21 detected by the temperature sensor 28. Alternatively, end of the time t1 is defined as a time when a preset time has elapsed.

If a user removes a recording medium P jammed at the fixing nip N while the pressure roller 22 exerts pressure to the fixing belt 21 at the fixing nip N, the user pulls the recording medium P sandwiched between the fixing belt 21 and the pressure roller 22 at the fixing nip N. Accordingly, the recording medium P may damage the fixing belt 21 and the pressure roller 22 or the recording medium P may be torn off, making it difficult for the user to remove the jammed recording medium P properly. Conversely, if the pressure roller 22 releases pressure exerted to the fixing belt 21 at the fixing nip N before the fixing belt 21 interrupts rotation, the fixing belt 21 may slip and suffer from temperature increase locally, resulting in deformation of the fixing belt 21. To address those circumstances, after the fixing belt 21 interrupts rotation, the switcher 60 places the pressure roller 22 at the depressurization position where the pressure roller 22 releases pressure exerted to the fixing belt 21 at the fixing nip N.

Figure 9:
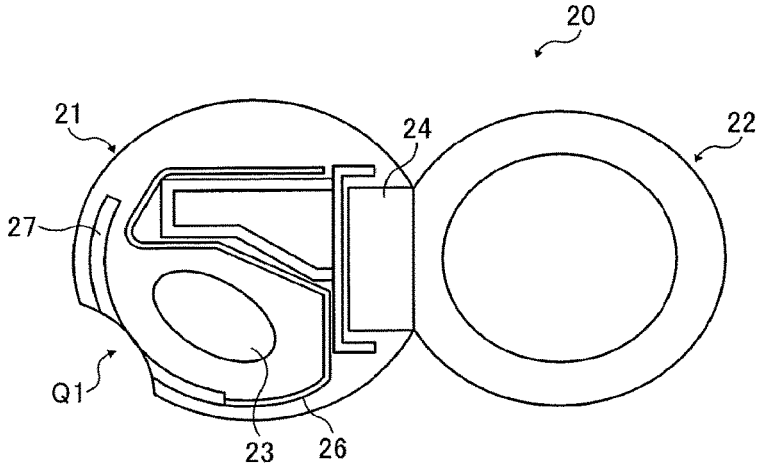
FIG. 9 is a schematic vertical cross-sectional view of the fixing device depicted in FIG. 3, illustrating a fixing belt that is deformed.

The above describes the sequence of the driving times of the components of the fixing device 20 when the print job finishes normally. However, during image formation from input of an image signal to the image forming apparatus 1 until ejection of the recording medium P bearing the fixed toner image T onto the output tray 14, if the recording medium P is jammed in the conveyance path R or a failure occurs in any of the components of the image forming apparatus 1, the image forming apparatus 1 may perform emergency stop. If the fixing belt 21 interrupts rotation immediately when the image forming apparatus 1 stops emergently, the fixing belt 21 may be heated by residual heat and may suffer from temperature irregularity, resulting in deformation of the fixing belt 21 as illustrated in FIG. 9 with a deformation region Q1. FIG. 9 is a schematic vertical cross-sectional view of the fixing device 20, illustrating the fixing belt 21 that is deformed.

A description is provided of a construction of a first comparative fixing device.

The first comparative fixing device includes a heater, a fixing rotator heated by the heater with radiant heat, and an opposed rotator that contacts the fixing rotator to form a fixing nip therebetween. As an image forming apparatus incorporating the first comparative fixing device starts a print job, a toner image is transferred onto a sheet serving as a recording medium. As the sheet passes through the fixing nip formed between the opposed rotator and the fixing rotator heated to a predetermined temperature, the fixing rotator and the opposed rotator melt and fix the toner image on the sheet under heat and pressure.

Compared to other components of the image forming apparatus, the first comparative fixing device consumes more power and is requested to save energy. To address this request, a second comparative fixing device includes a fixing rotator that is an endless belt (e.g., a fixing belt) that has a reduced thermal capacity and is thin like film. A heater heats the fixing belt directly not through a metal thermal conductor also serving as a support. Even if the second comparative fixing device is installed in the high speed image forming apparatus, the second comparative fixing device attains an improved fixing performance. The second comparative fixing device includes a pressure roller disposed opposite an outer circumferential surface of the fixing belt and a nip formation pad stationarily disposed inside a loop formed by the fixing belt. The pressure roller is pressed against the nip formation pad via the fixing belt to form a fixing nip between the pressure roller and the fixing belt.

However, in the second comparative fixing device in which the heater heats the fixing belt directly, the fixing belt is thin and has an enhanced responsiveness to radiant heat radiated from the heater. Accordingly, when the radiant heat from the heater irradiates the fixing belt while the fixing belt interrupts rotation, the temperature of the fixing belt increases excessively to a temperature higher than a heat resistant temperature of silicone rubber and fluoro rubber contained in the fixing belt and the pressure roller.

To address this circumstance, a controller performs a control to rotate the fixing belt forward to prevent temperature increase of the fixing belt. For example, when the print job finishes normally, the fixing belt rotates forward further for a predetermined time after the heater is powered off. Thereafter, the fixing belt interrupts rotation. Thus, the controller evens the temperature of the fixing belt in a circumferential direction of the fixing belt and prevents breakage of the fixing belt due to overheating of the fixing belt and the pressure roller.

An upstream recording medium detector and a downstream recording medium detector are disposed upstream and downstream from the fixing nip in a recording medium conveyance path, respectively. The controller performs a control to rotate the fixing belt backward to prevent temperature increase of the fixing belt. For example, the fixing belt rotates backward further for a predetermined time after the heater is powered off. Thereafter, the fixing belt interrupts rotation. Thus, even if a recording medium is jammed, the controller prevents breakage of the fixing belt due to overheating of the fixing belt and the pressure roller.

However, if no recording medium is between the upstream recording medium detector and the downstream recording medium detector, when a failure occurs, for example, when the recording medium is jammed, and the image forming apparatus stops emergently, the controller performs the control to rotate the fixing belt forward to prevent temperature increase of the fixing belt. Accordingly, even if the controller performs the control to rotate the fixing belt forward to prevent temperature increase of the fixing belt, the components of the second comparative fixing device, for example, the fixing belt, may be damaged according to a condition of the recording medium or the second comparative fixing device when the image forming apparatus stops emergently.

The driving times of the components of the fixing device 20 when a failure occurs differ between two cases: a first case in which the fixing belt 21 rotates forward and a second case in which the fixing belt 21 rotates backward.

Since the fixing belt 21 rotates forward during image formation, the fixing belt 21 is not configured to rotate backward during image formation. Hence, if the fixing belt 21 is configured to rotate forward even during emergency stop, damage to the fixing belt 21 is reduced.

Even if the recording medium P remains in the conveyance path R when the recording medium P is jammed, if a leading edge of the recording medium P has passed through the fixing nip N and has separated from the fixing belt 21, even if the fixing belt 21 further rotates forward in a feeding direction in which the fixing belt 21 feeds the recording medium P downstream in the recording medium conveyance direction A2 depicted in FIG. 2, the recording medium P is not wound around the fixing belt 21.

Even before the recording medium P remaining in the conveyance path R passes through the fixing nip N when the recording medium P is jammed, a separator disposed downstream from an exit of the fixing nip N in the recording medium conveyance direction A2 separates the recording medium P from the fixing belt 21. Accordingly, even if the fixing belt 21 rotates forward further, the recording medium P is not wound around the fixing belt 21. Hence, as the sequence of the driving times of the components of the fixing device 20 during normal emergency stop, after the halogen heater 23 is turned off, the fixing belt 21 rotates forward to attain stable conveyance of the recording medium P.

Figure 10:
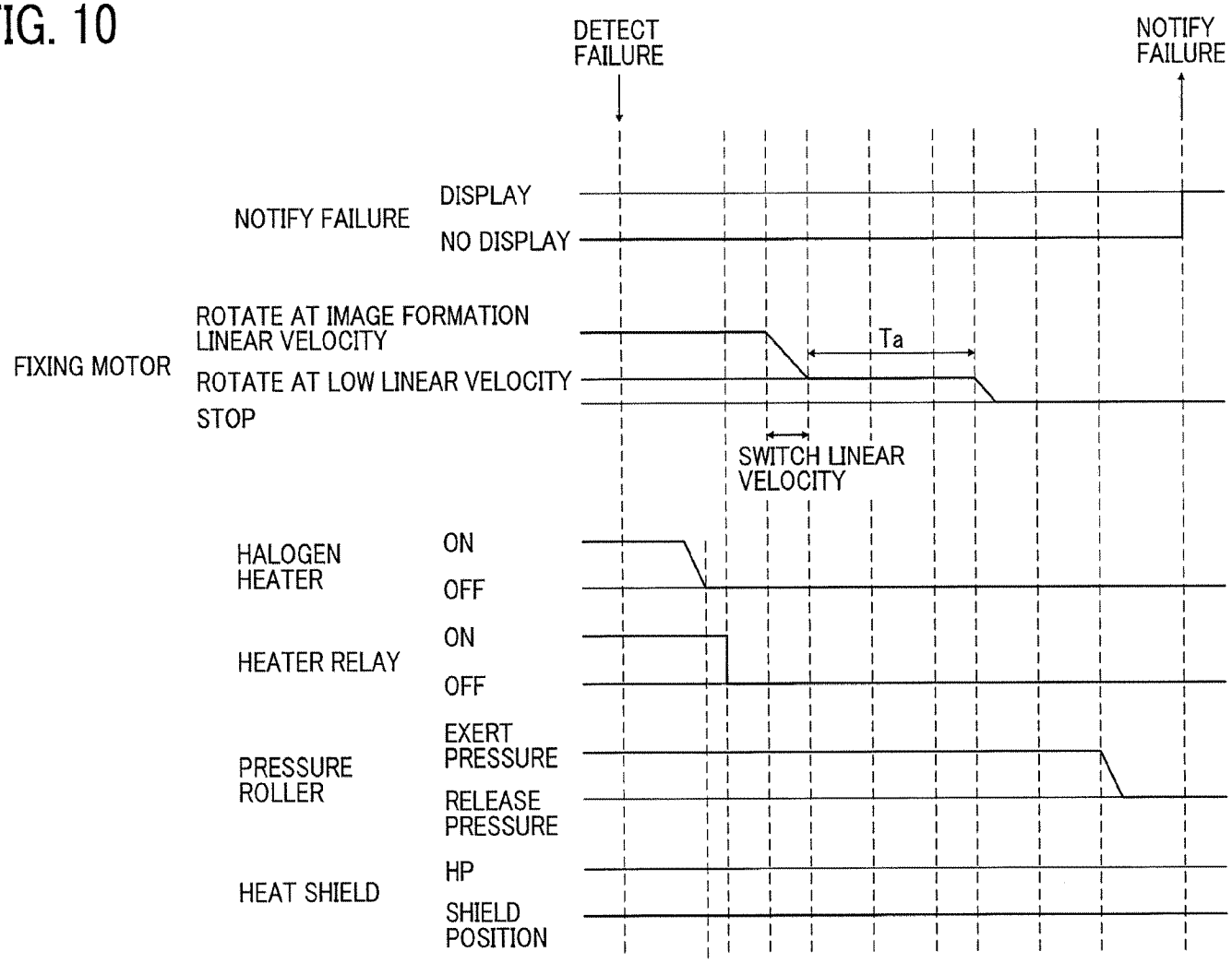
FIG. 10 is a timing chart illustrating the sequence of the driving times of the components of the fixing device depicted in FIG. 3 in a first case in which the fixing belt rotates forward when a failure occurs.

Referring to FIG. 10, a description is provided of the sequence of the driving times of the components of the fixing device 20 if the fixing belt 21 rotates forward when a failure occurs, which is called a forward rotation against failure.

FIG. 10 is a timing chart illustrating the sequence of the driving times of the components of the fixing device 20 in the first case in which the fixing belt 21 rotates forward when a failure occurs.

When the fixing device 20 receives a failure detection signal from the image forming apparatus 1, the halogen heater 23 is turned off. Subsequently, the heater relay is turned off. After the heater relay is turned off, the controller 90 slows down the linear velocity of the fixing belt 21 to a low linear velocity that is lower than an image formation linear velocity at which the fixing belt 21 conveys the recording medium P to fix the toner image T on the recording medium P. The fixing belt 21 rotates forward for a predetermined time Ta at the low linear velocity. After the time Ta elapses, the fixing belt 21 interrupts rotation. Thereafter, the switcher 60 moves the pressure roller 22 to the depressurization position where the pressure roller 22 releases pressure exerted to the fixing belt 21 at the fixing nip N. After changing the driving times of the components of the fixing device 20 described above, the controller 90 notifies the user of the failure with a notification device of the image forming apparatus 1. For example, the notification device is a control panel that displays a message, an indicator lamp that emits light, an alarm that generates a noise, or the like, to alert the user to the failure. After notifying the user of the failure, the controller 90 prohibits the user from using the fixing device 20.

While the fixing belt 21 rotates forward after the halogen heater 23 is turned off, the halogen heater 23 heats the fixing belt 21 with residual heat in an unshielded span of the circumferential heated span α depicted in FIG. 2 of the fixing belt 21 where the heat shield 27 does not shield the fixing belt 21 from the halogen heater 23. As the fixing belt 21 rotates forward, the recording medium P passes through the fixing nip N and draws heat from the fixing belt 21, causing no substantial temperature deviation of the fixing belt 21. Accordingly, the fixing device 20 prevents temperature irregularity and deformation of the fixing belt 21.

The time Ta for which the fixing belt 21 rotates forward is long enough for the fixing belt 21 to conduct heat to the recording medium P as the entire circumference of the fixing belt 21 passes through the fixing nip N and to conduct heat to the pressure roller 22 after the recording medium P passes through the fixing nip N. For example, the time Ta is a time for which the fixing belt 21 performs one rotation. The controller 90 switches the linear velocity of the fixing belt 21 while the fixing belt 21 rotates forward to the low linear velocity to facilitate conduction of heat from the fixing belt 21 to the recording medium P, thus reducing temperature deviation of the fixing belt 21.

A description is provided of the sequence of the driving times of the components of the fixing device 20 if the fixing belt 21 rotates backward when a failure occurs, which is called a backward rotation against failure.

The image forming apparatus 1 uses various types of the recording media P (e.g., sheets). For example, the image forming apparatus 1 forms a toner image on a long-length sheet used in electronics retail stores more frequently. The long-length sheet has a thickness, a length, a type, and a surface that vary depending on the usage of the long-length sheet. Hence, the long-length sheet is more susceptible to jamming during conveyance and erroneous setting by the user than plain paper.

When the long-length sheet is jammed during conveyance, the feed roller 11, the timing roller pair 12, the secondary transfer roller 36, and the secondary transfer backup roller 32, which are hereinafter referred to as the plurality of rotary bodies, and the fixing belt 21 and the pressure roller 22, which are hereinafter referred to as the fixing nip N, may sandwich the recording medium P simultaneously. In this case, the recording medium P is sandwiched with a substantial force by the plurality of rotary bodies, that is, the feed roller 11, the timing roller pair 12, the secondary transfer roller 36, and the secondary transfer backup roller 32, which are disposed upstream from the fixing nip N in the recording medium conveyance direction A1. Accordingly, even if the controller 90 controls the fixing belt 21 to rotate forward, a load imposed on the fixing belt 21 (e.g., a fixing rotator driving load) when driving the fixing belt 21 may be too great to rotate the fixing belt 21. Consequently, the halogen heater 23 may heat the fixing belt 21 with residual heat, generating temperature irregularity of the fixing belt 21.

In addition to the long-length sheet, the load imposed on the fixing belt 21 when driving the fixing belt 21 may increase according to the type, the thickness, or the like of the recording medium P when the recording medium P is jammed. Accordingly, the fixing belt 21 may not rotate.

For example, the timing roller pair 12 has a great driving torque and sandwiches the recording medium P with a substantial force. If the fixing belt 21 and the pressure roller 22 at the fixing nip N and the timing roller pair 12 sandwich the recording medium P simultaneously when a failure occurs, a conveyance force of the fixing belt 21 to convey the recording medium P is smaller than a conveyance force of the timing roller pair 12 to convey the recording medium P. Accordingly, even if the controller 90 controls the fixing belt 21 to rotate in a forward direction, the controller 90 may fail to rotate the fixing belt 21 as intended. To address this circumstance, the controller 90 is requested to determine to rotate the fixing belt 21 in a backward direction opposite the forward direction.

Conversely, if the timing roller pair 12 does not sandwich the recording medium P, that is, if the fixing nip N formed by the fixing belt 21 and the pressure roller 22 and the secondary transfer nip defined by the secondary transfer roller 36 pressed against the secondary transfer backup roller 32 via the intermediate transfer belt 30 sandwich the recording medium P simultaneously when a failure occurs, the conveyance force of the fixing belt 21 to convey the recording medium P is greater than a conveyance force of the secondary transfer nip (e.g., the secondary transfer roller 36) to convey the recording medium P. Accordingly, the controller 90 controls the fixing belt 21 to rotate forward as intended. In this case, the controller 90 is requested to determine to rotate the fixing belt 21 in the forward direction.

To address this request, according to this embodiment, when a failure occurs, if the fixing nip N and at least one of the plurality of rotary bodies sandwich a single recording medium P, that is, an identical recording medium P, simultaneously, the controller 90 determines to rotate the fixing belt 21 forward in the predetermined forward direction or backward in the backward direction opposite the forward direction according to the at least one of the plurality of rotary bodies sandwiching the recording medium P. For example, according to this embodiment, if a conveyance nip other than the fixing nip N sandwiches the recording medium P, the controller 90 determines in which direction the fixing belt 21 rotates, forward or backward, based on at least one of a rotation load imposed on the fixing belt 21, presence (e.g., a position) of the recording medium P detected by a recording medium detector, and a rotation speed of the fixing belt 21 detected by a speed detector when the fixing belt 21 starts rotation.

A description is provided of a configuration of the fixing device 20 according to a first embodiment.

Figure 11:
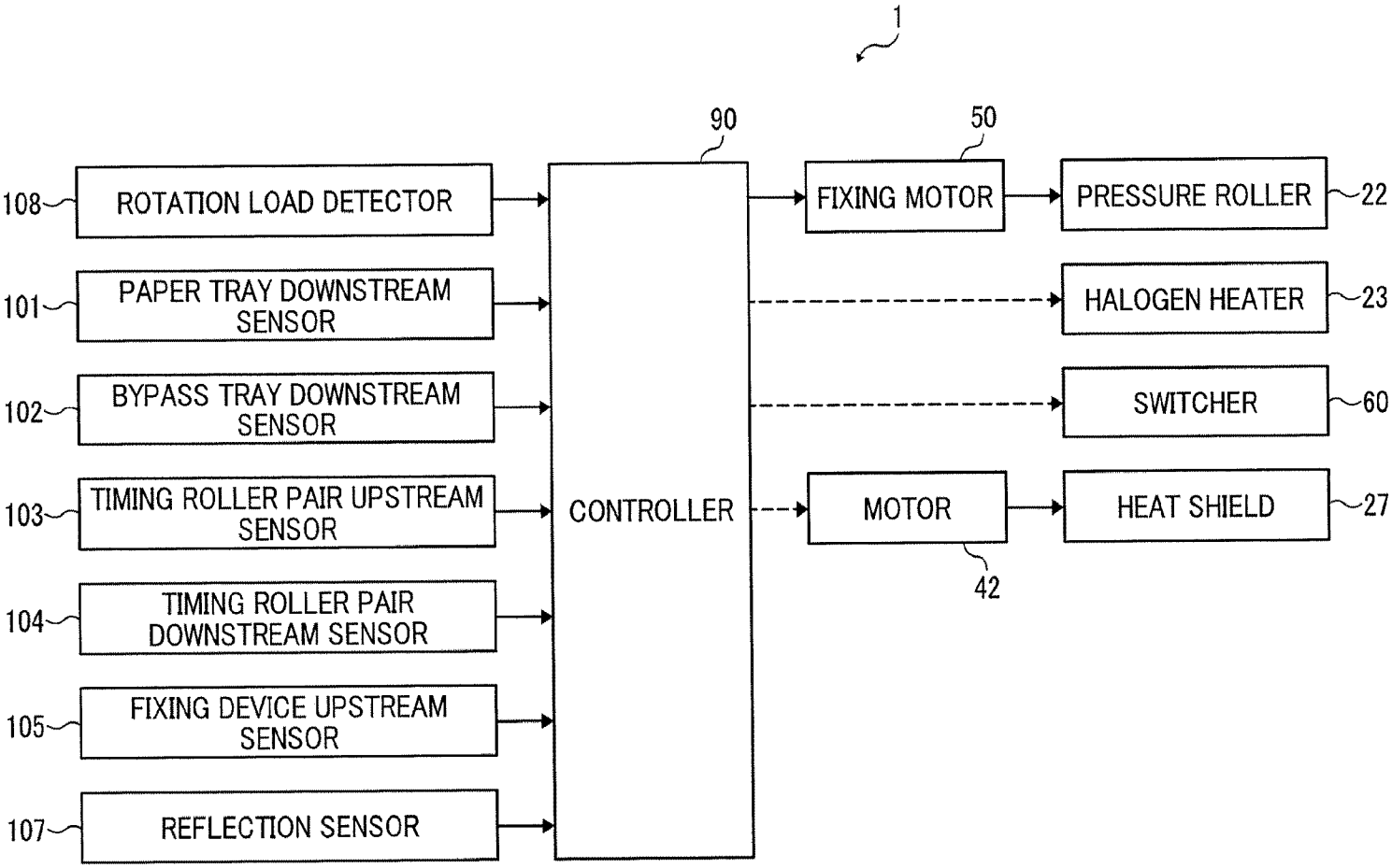
FIG. 11 is a block diagram of the image forming apparatus depicted in FIG. 1, illustrating a configuration of the fixing device according to a first embodiment.

FIG. 11 is a block diagram of the image forming apparatus 1. As illustrated in FIG. 11, according to the first embodiment, in order to prevent temperature irregularity generated by the causes described above, the image forming apparatus 1 includes a rotation load detector 108 that measures the fixing rotator driving load (e.g., the rotation load) imposed on the fixing belt 21. When a failure occurs, the rotation load detector 108 measures the fixing rotator driving load imposed on the fixing belt 21 that rotates forward. If the fixing rotator driving load imposed on the fixing belt 21 is a predetermined value or greater, the controller 90 rotates the fixing belt 21 backward, not forward. Accordingly, even if at least one of the plurality of rotary bodies disposed upstream from the fixing nip N in the recording medium conveyance direction A1 sandwiches the recording medium P, the fixing belt 21 rotating backward loosens the recording medium P. Consequently, a small driving force generated by the fixing motor 50 rotates the fixing belt 21, preventing temperature irregularity of the fixing belt 21.

Figure 12:
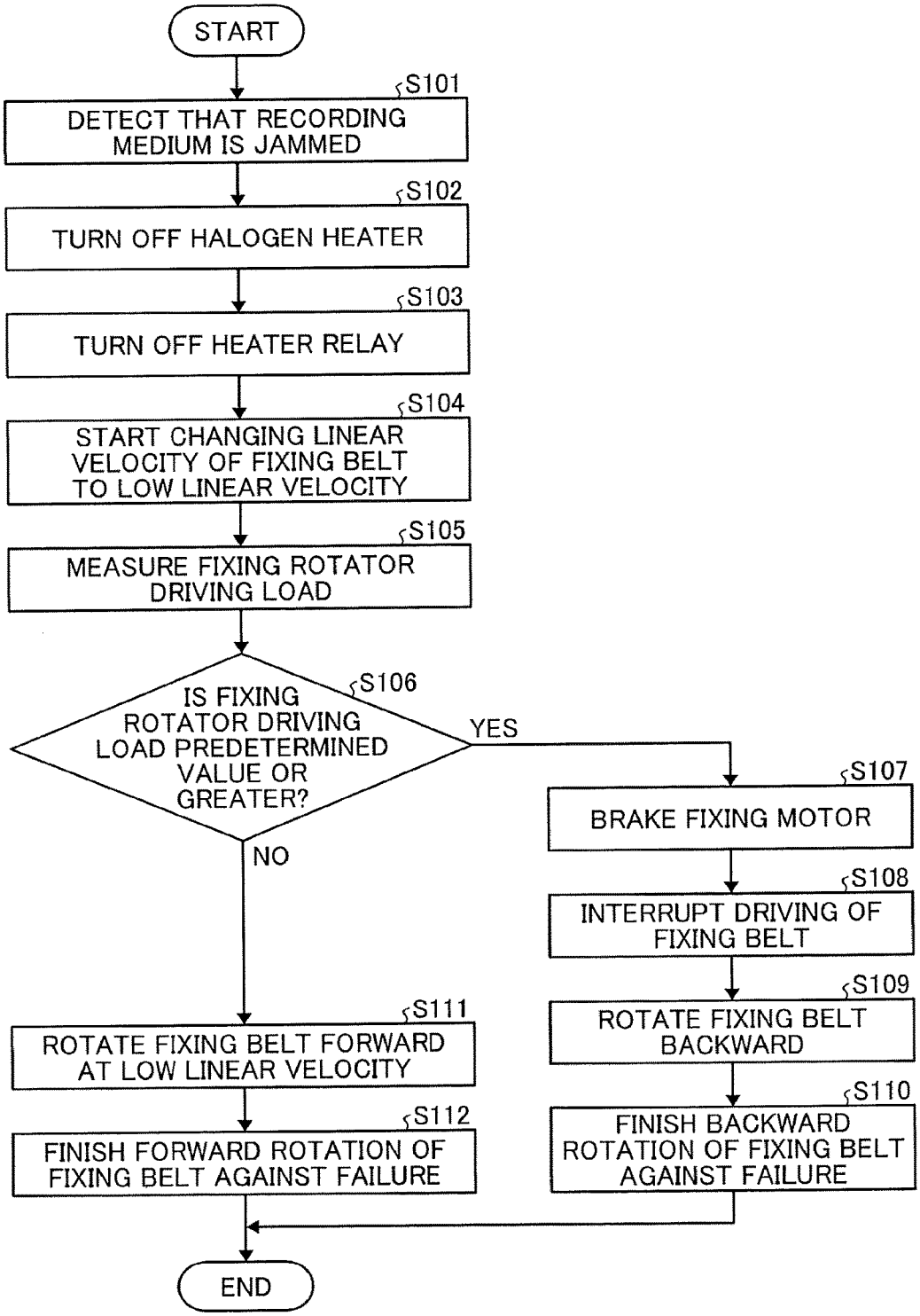
FIG. 12 is a flowchart illustrating a control for selecting a rotation direction of the fixing belt when a failure occurs.

Referring to FIG. 12, a description is provided of a control for selecting the rotation direction of the fixing belt 21, forward or backward, when a failure occurs.

FIG. 12 is a flowchart illustrating the control for selecting the rotation direction of the fixing belt 21, forward or backward, when a failure occurs.

In step S101, the controller 90 of the image forming apparatus 1 detects that the recording medium P is jammed. In step S102, the controller 90 turns off the halogen heater 23. In step S103, the controller 90 turns off the heater relay. After the controller 90 turns off the heater relay, the controller 90 slows down the linear velocity of the fixing belt 21 to the low linear velocity that is lower than the image formation linear velocity at which the fixing belt 21 conveys the recording medium P to fix the toner image T on the recording medium P in step S104. In step S105, while the fixing belt 21 rotates forward for the predetermined time Ta at the low linear velocity, the controller 90 causes the rotation load detector 108 to measure the fixing rotator driving load imposed on the fixing belt 21. The rotation load detector 108 is a measurement device that measures a driving torque of the fixing belt 21. Alternatively, the rotation load detector 108 may be a calculation device that calculates the driving torque of the fixing belt 21 by measuring an electric current value of the fixing motor 50. In step S106, the controller 90 determines whether or not the fixing rotator driving load is a predetermined value X [Nm] or greater.

If the controller 90 determines that the fixing rotator driving load is the predetermined value or greater (YES in step S106), the controller 90 determines that the fixing rotator driving load imposed on the fixing belt 21 may be too great for the fixing belt 21 to rotate. In step S107, the controller 90 brakes the fixing motor 50 to stop. In step S108, the fixing motor 50 interrupts driving of the fixing belt 21. After the fixing belt 21 interrupts rotation, the controller 90 rotates the fixing belt 21 backward for a predetermined time Td in step S109. Subsequently, the controller 90 stops the fixing motor 50. The controller 90 controls the switcher 60 to move the pressure roller 22 from the pressurization position to the depressurization position, thus finishing the backward rotation of the fixing belt 21 against failure in step S110 and therefore finishing the control for selecting the rotation direction of the fixing belt 21.

If the controller 90 determines that the fixing rotator driving load is not the predetermined value or greater (NO in step S106), the controller 90 determines that the fixing belt 21 is rotatable in the forward direction. In step S111, the controller 90 performs the forward rotation of the fixing belt 21 against failure that rotates the fixing belt 21 forward at the low linear velocity as illustrated in FIG. 10. Subsequently, the controller 90 stops the fixing motor 50. The controller 90 controls the switcher 60 to move the pressure roller 22 from the pressurization position to the depressurization position, thus finishing the forward rotation of the fixing belt 21 against failure in step S112 and therefore finishing the control for selecting the rotation direction of the fixing belt 21.

Figure 13:
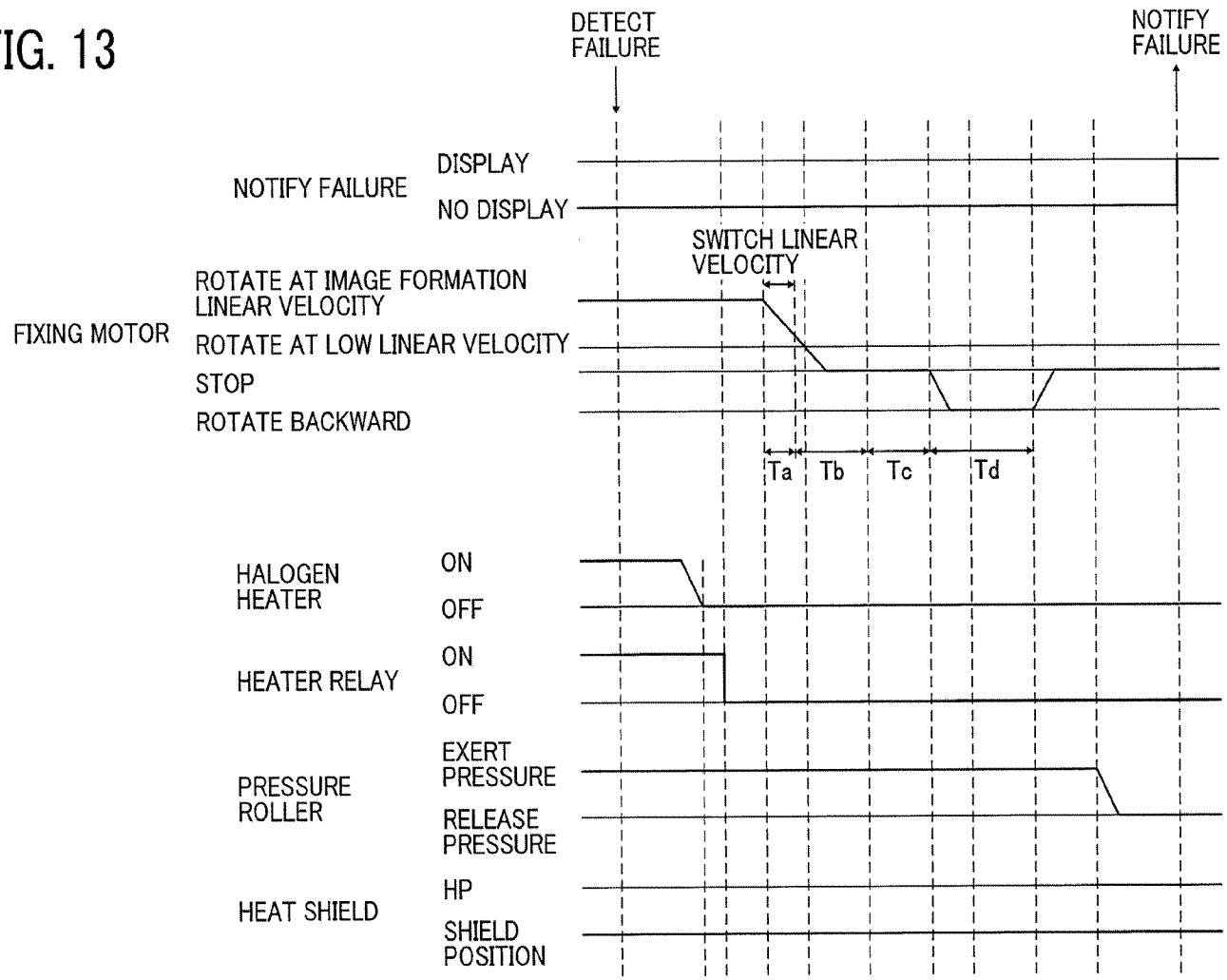
FIG. 13 is a timing chart illustrating the sequence of the driving times of the components of the fixing device depicted in FIG. 3 in a second case in which the fixing belt rotates backward when a failure occurs.

Referring to FIG. 13, a description is provided of the sequence of the driving times of the components of the fixing device 20 if the fixing belt 21 rotates backward when a failure occurs, which is called the backward rotation against failure.

FIG. 13 is a timing chart illustrating the sequence of the driving times of the components of the fixing device 20 in the second case in which the fixing belt 21 rotates backward when a failure occurs.

When the fixing device 20 receives a failure detection signal from the image forming apparatus 1, the halogen heater 23 is turned off. Subsequently, the heater relay is turned off. After the heater relay is turned off, the controller 90 slows down the linear velocity of the fixing belt 21 to the low linear velocity that is lower than the image formation linear velocity at which the fixing belt 21 conveys the recording medium P to fix the toner image T on the recording medium P. While the fixing belt 21 rotates forward for the predetermined time Ta at the low linear velocity, the controller 90 causes the rotation load detector 108 to measure the fixing rotator driving load imposed on the fixing belt 21. When the fixing rotator driving load is the predetermined value X [Nm] or greater, the controller 90 brakes the fixing motor 50 for a predetermined time Tb immediately, stopping the fixing belt 21.

The controller 90 forcibly stops the fixing motor 50 for a predetermined time Tc. Thereafter, the controller 90 drives and rotates the fixing motor 50 backward for a predetermined time Td. After the predetermined time Td elapses, the controller 90 stops the fixing motor 50. Thereafter, the switcher 60 moves the pressure roller 22 to the depressurization position where the pressure roller 22 releases pressure exerted to the fixing belt 21 at the fixing nip N. After changing the driving times of the components of the fixing device 20 described above, the controller 90 notifies the user of the failure with the notification device of the image forming apparatus 1. After notifying the user of the failure, the controller 90 prohibits the user from using the fixing device 20.

The time Td for which the fixing belt 21 rotates backward is a time for which the fixing belt 21 performs one rotation, for example. A linear velocity of the fixing belt 21 rotating backward when the failure occurs is lower than a linear velocity of the fixing belt 21 rotating forward when no failure occurs. Accordingly, the controller 90 facilitates conduction of heat from the fixing belt 21 to the recording medium P, thus reducing temperature deviation of the fixing belt 21.

While the fixing motor 50 rotates the fixing belt 21 backward, the halogen heater 23 heats the fixing belt 21 with residual heat in the unshielded span of the circumferential heated span $\alpha$ depicted in FIG. 2 of the fixing belt 21 where the heat shield 27 does not shield the fixing belt 21 from the halogen heater 23. Like the first case in which the fixing belt 21 rotates forward, as the fixing belt 21 rotates backward, the recording medium P passes through the fixing nip N in a direction opposite the recording medium conveyance direction A1. Accordingly, the recording medium P draws heat from the fixing belt 21. Consequently, the fixing belt 21 is immune from substantial temperature deviation, preventing temperature irregularity and deformation of the fixing belt 21.

Since the controller 90 employs the control to rotate the fixing belt 21 forward or backward as described above, when the failure occurs in the image forming apparatus 1, the controller 90 stops the fixing device 20 and the image forming apparatus 1 quickly, reducing damage to the components of the image forming apparatus 1. Accordingly, the controller 90 prevents temperature irregularity and deformation of the fixing belt 21.

As illustrated in FIG. 13, the controller 90 brakes and forcibly stops the fixing motor 50 before rotating the fixing motor 50 backward to prevent the fixing motor 50 from being broken when rotation of the fixing motor 50 switches from forward rotation to backward rotation. If the fixing device 20 employs the fixing motor 50 for which the controller 90 is capable of switching rotation from forward rotation to backward rotation by skipping braking and forcible stoppage, braking and forcible stoppage of the fixing motor 50 are not necessary.

A description is provided of a configuration of the fixing device 20 according to a second embodiment in which the controller 90 determines to rotate the fixing belt 21 forward or backward.

Figure 14:
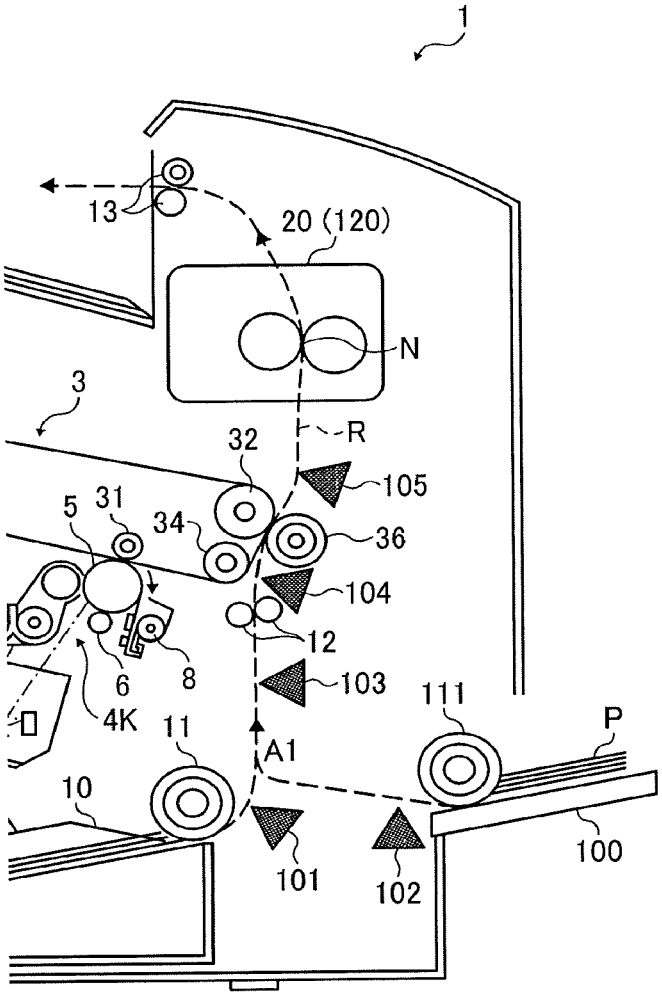
FIG. 14 is a partial vertical cross-sectional view of the image forming apparatus depicted in FIG. 1, illustrating a configuration of the fixing device according to a second embodiment.

FIG. 14 is a partial vertical cross-sectional view of the image forming apparatus 1, illustrating the configuration of the fixing device 20 according to the second embodiment in which the controller 90 determines to rotate the fixing belt 21 forward or backward.

According to the second embodiment, the controller 90 determines to rotate the fixing belt 21 forward or backward based on a detection result provided by a recording medium detector situated in the conveyance path R.

The image forming apparatus 1 includes a bypass tray 100, a feed roller 111 that feeds a recording medium P from the bypass tray 100, and the recording medium detector. The recording medium detector that detects presence of the recording medium P includes at least one of a paper tray downstream sensor 101 serving as a sheet tray downstream sensor, a bypass tray downstream sensor 102, a timing roller pair upstream sensor 103, a timing roller pair downstream sensor 104, and a fixing device upstream sensor 105.

The paper tray downstream sensor 101 detects a recording medium P remaining after the feed roller 11 feeds the recording medium P from the paper tray 10. The bypass tray downstream sensor 102 detects a recording medium P remaining after the feed roller 111 feeds the recording medium P from the bypass tray 100. The timing roller pair upstream sensor 103 detects the recording medium P remaining at a position disposed upstream from the timing roller pair 12 in the recording medium conveyance direction A1. The timing roller pair downstream sensor 104 detects the recording medium P remaining at a position disposed downstream from the timing roller pair 12 in the recording medium conveyance direction A1. The fixing device upstream sensor 105 detects the recording medium P remaining at a position disposed upstream from the fixing device 20 in the recording medium conveyance direction A1.

The paper tray downstream sensor 101, the bypass tray downstream sensor 102, the timing roller pair upstream sensor 103, the timing roller pair downstream sensor 104, and the fixing device upstream sensor 105 are disposed upstream from the fixing nip N in the recording medium conveyance direction A1 to detect presence of the recording medium P at the positions disposed upstream and downstream from the plurality of rotary bodies, that is, the feed roller 11, the timing roller pair 12, the secondary transfer roller 36, the secondary transfer backup roller 32, and the fixing belt 21. The controller 90 determines whether or not the rotary body sandwiches the recording medium P based on a detection result provided by the recording medium sensor.

If a long-length recording medium P as described above is jammed and all of the bypass tray downstream sensor 102, the timing roller pair upstream sensor 103, the timing roller pair downstream sensor 104, and the fixing device upstream sensor 105 determine that the recording medium P remains, the fixing rotator driving load imposed on the fixing belt 21 increases. In this case, the controller 90 drives and rotates the fixing belt 21 backward. Alternatively, the recording medium detector may determine presence of the recording medium P in combination with determination based on the size of the recording medium P specified by the user.

Figure 15:
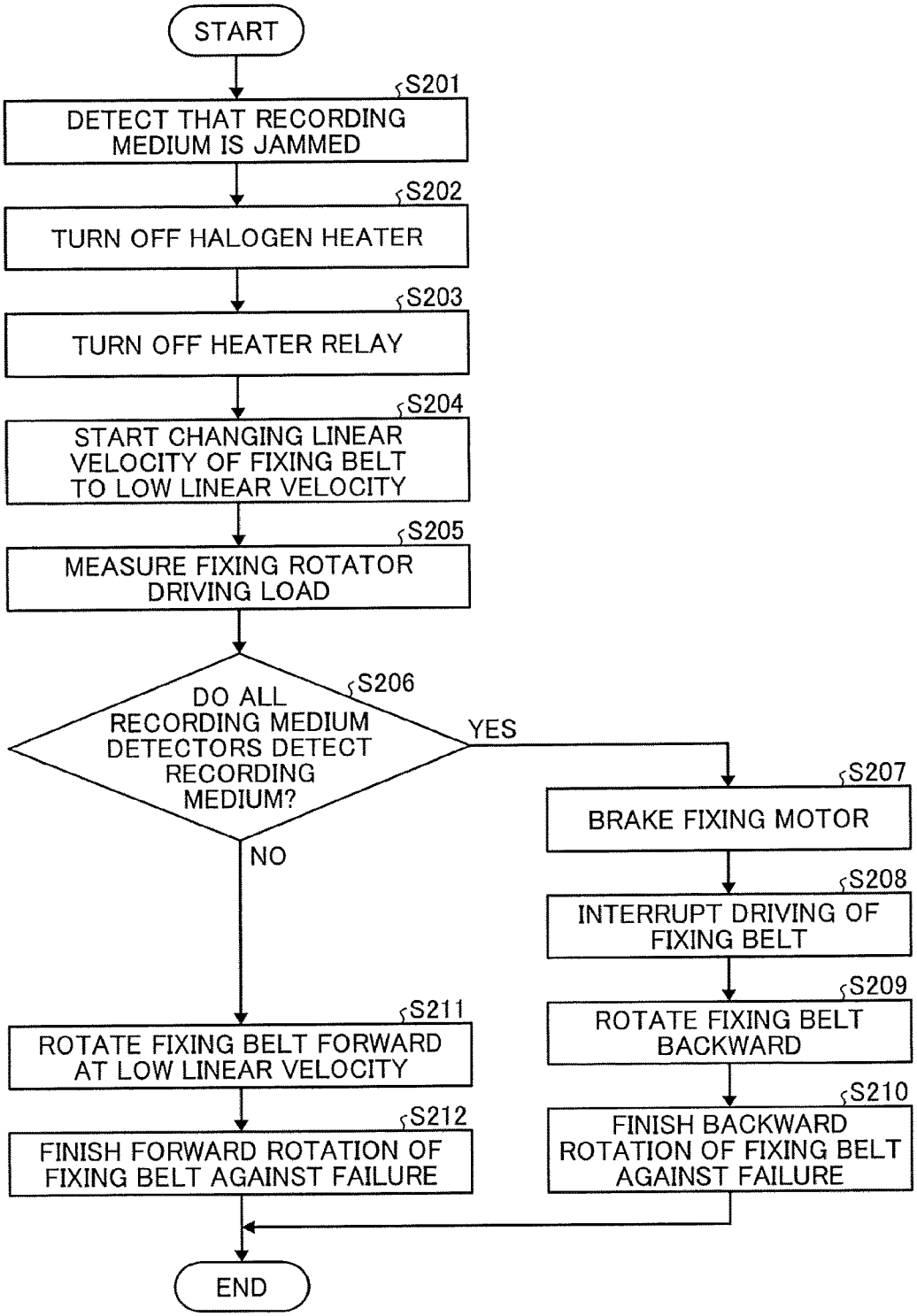
FIG. 15 is a flowchart illustrating the control for selecting the rotation direction of the fixing belt incorporated in the fixing device depicted in FIG. 14 according to the second embodiment.

Referring to FIG. 15, a description is provided of a control for selecting the rotation direction of the fixing belt 21, forward or backward, when a failure occurs.

FIG. 15 is a flowchart illustrating the control for selecting the rotation direction of the fixing belt 21, forward or backward, according to the second embodiment.

According to the second embodiment, the controller 90 performs steps S201 to S205 equivalent to steps S101 to S105 depicted in FIG. 12. Thereafter, the controller 90 determines whether or not all of the bypass tray downstream sensor 102, the timing roller pair upstream sensor 103, the timing roller pair downstream sensor 104, and the fixing device upstream sensor 105 detect that the recording medium P remains in step S206.

If the controller 90 determines that all of the bypass tray downstream sensor 102, the timing roller pair upstream sensor 103, the timing roller pair downstream sensor 104, and the fixing device upstream sensor 105 detect that the recording medium P remains (YES in step S206), the controller 90 determines that the fixing rotator driving load imposed on the fixing belt 21 may be too great for the fixing belt 21 to rotate. The controller 90 performs steps S207 to S210 equivalent to steps S107 to S110 depicted in FIG. 12 and finishes the control.

If the controller 90 determines that all of the bypass tray downstream sensor 102, the timing roller pair upstream sensor 103, the timing roller pair downstream sensor 104, and the fixing device upstream sensor 105 detect that no recording medium P remains (NO in step S206), the controller 90 determines that the fixing belt 21 is rotatable in the forward direction. The controller 90 performs steps S211 and S212 equivalent to steps S111 and S112 depicted in FIG. 12 and finishes the control.

Since the controller 90 employs the control to rotate the fixing belt 21 forward or backward as described above, when the failure occurs in the image forming apparatus 1, the controller 90 stops the fixing device 20 and the image forming apparatus 1 quickly, reducing damage to the components of the image forming apparatus 1. Accordingly, the controller 90 prevents temperature irregularity and deformation of the fixing belt 21.

The positions of the recording medium detectors and combination of the recording medium detectors used for determination of the controller 90 vary depending on the specification of the image forming apparatus 1 and therefore are set arbitrarily based on the size of the image forming apparatus 1 and the layout of the conveyance path R.

A description is provided of a configuration of the fixing device 20 according to a third embodiment in which the controller 90 determines to rotate the fixing belt 21 forward or backward.

Figure 16:
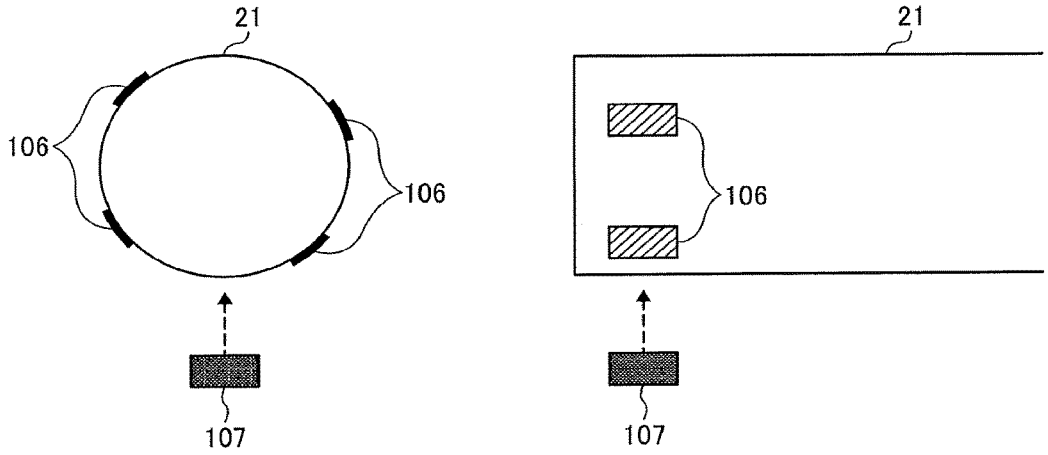
FIG. 16 is a diagram of the fixing belt incorporated in the fixing device depicted in FIG. 3, illustrating a configuration of the fixing device according to a third embodiment.

FIG. 16 is a diagram of the fixing belt 21, illustrating the configuration of the fixing device 20 according to the third embodiment in which the controller 90 determines to rotate the fixing belt 21 forward or backward.

According to the third embodiment, the controller 90 determines to rotate the fixing belt 21 forward or backward based on a detection result provided by a speed detector that detects the rotation speed of the fixing belt 21.

As illustrated in FIG. 16, markings 106 are disposed on one lateral end of the fixing belt 21 in the axial direction thereof. A reflectance of the markings 106 is different from a reflectance of the outer circumferential surface of the fixing belt 21. A reflection sensor 107 serving as a speed detector disposed in proximity to the fixing belt 21 detects change in the reflectance that generates in accordance with rotation of the fixing belt 21. If a rotation cycle of the markings 106 detected by the reflection sensor 107 is longer than a predetermined rotation cycle, that is, if a rotation speed of the fixing belt 21 detected by the speed detector is a predetermined speed or lower, the fixing belt 21 does not rotate at a target rotation speed, increasing the fixing rotator driving load imposed on the fixing belt 21. In this case, the controller 90 drives and rotates the fixing belt 21 backward.

Figure 17:
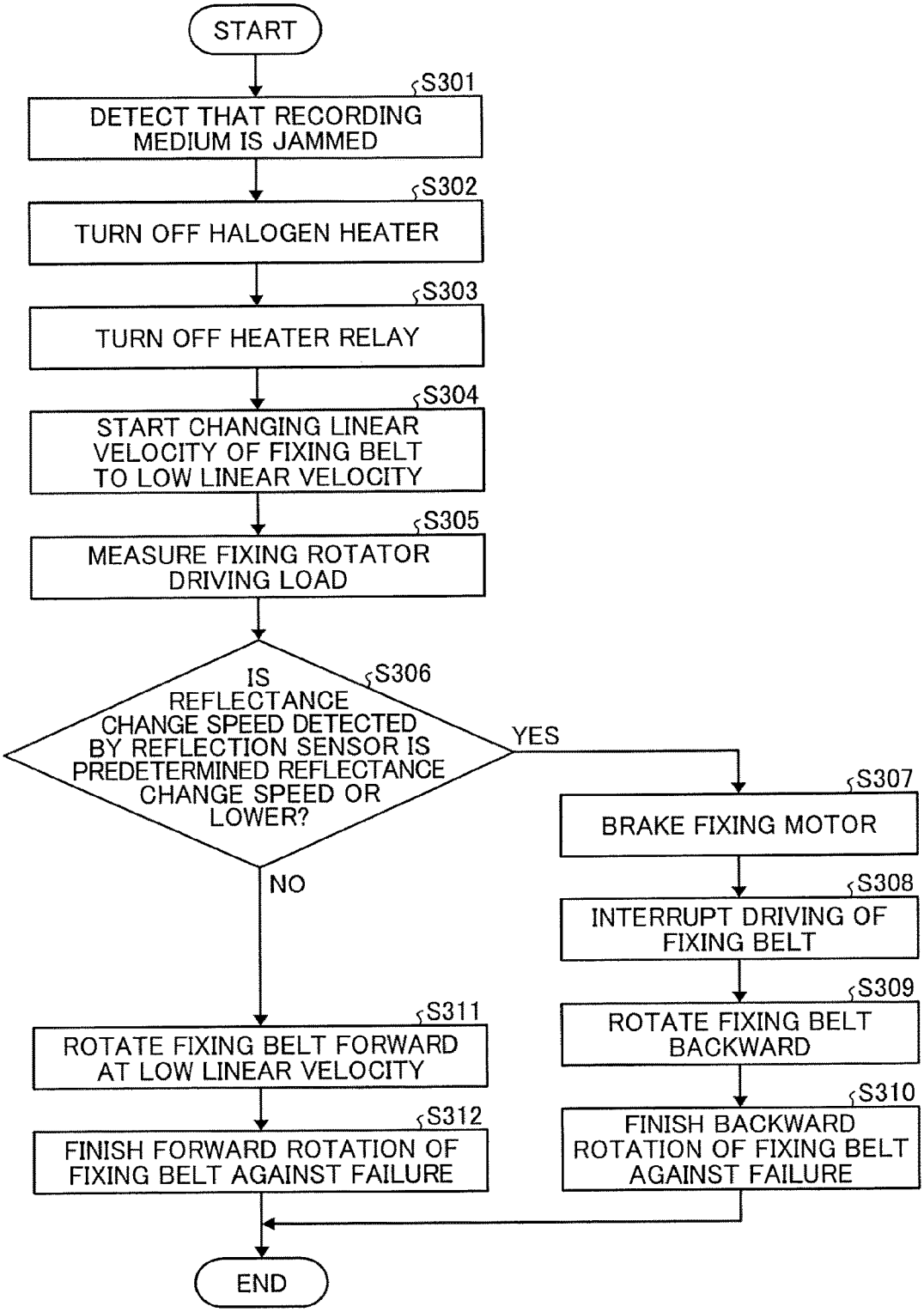
FIG. 17 is a flowchart illustrating the control for selecting the rotation direction of the fixing belt depicted in FIG. 16 of the fixing device according to the third embodiment.

Referring to FIG. 17, a description is provided of a control for selecting the rotation direction of the fixing belt 21, forward or backward, when a failure occurs.

FIG. 17 is a flowchart illustrating the control for selecting the rotation direction of the fixing belt 21, forward or backward, according to the third embodiment.

According to the third embodiment, the controller 90 performs steps S301 to S305 equivalent to steps S101 to S105 depicted in FIG. 12. In step S306, the controller 90 determines whether or not a reflectance change speed detected by the reflection sensor 107 is a predetermined reflectance change speed V [ms] or lower.

If the controller 90 determines that the reflectance change speed detected by the reflection sensor 107 is the predetermined reflectance change speed V or lower (YES in step S306), the controller 90 determines that the fixing rotator driving load imposed on the fixing belt 21 may be too great for the fixing belt 21 to rotate. The controller 90 performs steps S307 to S310 equivalent to steps S107 to S110 depicted in FIG. 12 and finishes the control.

If the controller 90 determines that the reflectance change speed detected by the reflection sensor 107 is not the predetermined reflectance change speed V or lower (NO in step S306), the controller 90 determines that the fixing belt 21 is rotatable in the forward direction. The controller 90 performs steps S311 and S312 equivalent to steps S111 and S112 depicted in FIG. 12 and finishes the control.

Since the controller 90 employs the control to rotate the fixing belt 21 forward or backward as described above, when the failure occurs in the image forming apparatus 1, the controller 90 stops the fixing device 20 and the image forming apparatus 1 quickly, reducing damage to the components of the image forming apparatus 1. Additionally, the controller 90 prevents temperature irregularity and deformation of the fixing belt 21.

A description is provided of a construction of a fixing device 120 according to another embodiment.

Figure 18:
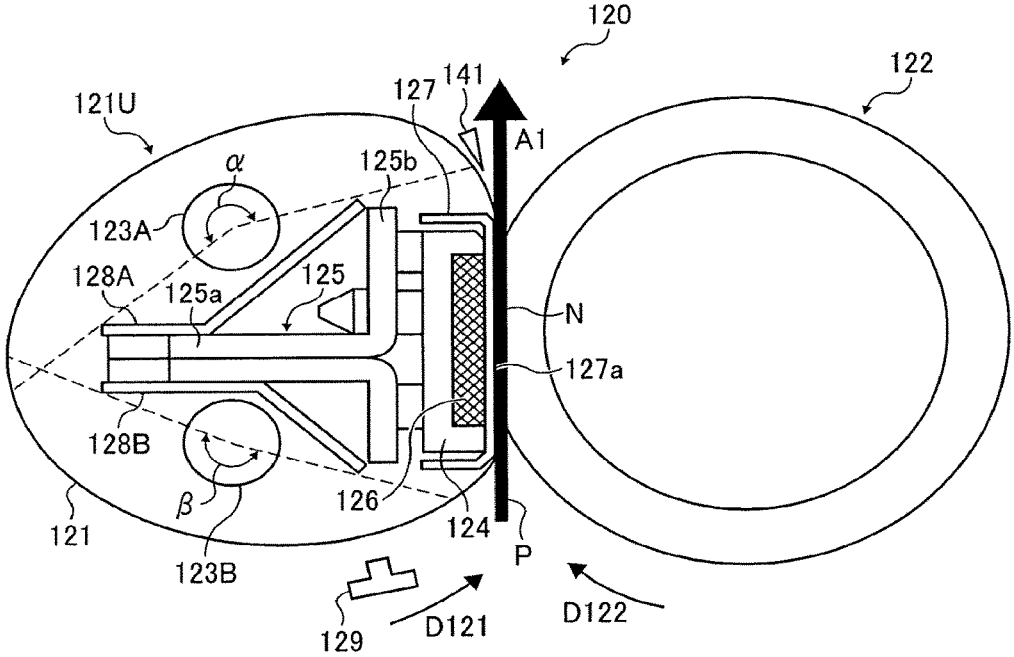
FIG. 18 is a schematic vertical cross-sectional view of a fixing device installable in the image forming apparatus depicted in FIG. 1, which incorporates a plurality of lateral end heaters.

Determination of the controller 90 to determine to rotate the fixing belt 21 forward or backward according to the embodiments described above is also applicable to a fixing device incorporating a lateral end heater. FIG. 18 is a schematic vertical cross-sectional view of the fixing device 120 according to this embodiment.

The fixing device 120 (e.g., a fuser or a fusing unit) includes a fixing belt 121 and a pressure roller 122. The fixing belt 121, serving as a fixing rotator or a fixing member, is an endless belt that is thin, flexible, tubular, and rotatable in a rotation direction D121 and a direction opposite the rotation direction D121. The pressure roller 122, serving as a pressure rotator or a pressure member, contacts an outer circumferential surface of the fixing belt 121. The pressure roller 122 is rotatable in a rotation direction D122 and a direction opposite the rotation direction D122. Inside a loop formed by the fixing belt 121 is a plurality of heaters or a plurality of fixing heaters, that is, a halogen heater 123A serving as a first halogen heater and a halogen heater 123B serving as a second halogen heater, that heats the fixing belt 121 with radiant heat. Each of the halogen heaters 123A and 123B is a radiant heater serving as a main heater or a fixing heater.

Inside the loop formed by the fixing belt 121 are a nip formation pad 124, a stay 125, lateral end heaters 126, a thermal conduction aid 127, and reflectors 128A and 128B. The components disposed inside the loop formed by the fixing belt 121, that is, the halogen heaters 123A and 123B, the nip formation pad 124, the stay 125, the lateral end heaters 126, the thermal conduction aid 127, and the reflectors 128A and 128B, may construct a belt unit 121U separably coupled with the pressure roller 122. The nip formation pad 124 presses against the pressure roller 122 via the fixing belt 121 to form the fixing nip N between the fixing belt 121 and the pressure roller 122. The stay 125, serving as a support, supports the nip formation pad 124.

A detailed description is now given of a configuration of the nip formation pad 124.

The nip formation pad 124 extending in a longitudinal direction thereof parallel to an axial direction of the fixing belt 121 is secured to and supported by the stay 125. Accordingly, even if the nip formation pad 124 receives pressure from the pressure roller 122, the stay 125 prevents the nip formation pad 124 from being bent by the pressure and therefore allows the nip formation pad 124 to produce a uniform nip length in the recording medium conveyance direction A1 throughout the entire width of the pressure roller 122 in an axial direction or a longitudinal direction thereof. The nip formation pad 124 is made of a heat resistant material being resistant against temperatures up to 200 degrees centigrade and having an enhanced mechanical strength. For example, the nip formation pad 124 is made of heat resistant resin such as PI, PEEK, and PI or PEEK reinforced with glass fiber. Thus, the nip formation pad 124 is immune from thermal deformation at temperatures in a fixing temperature range desirable to fix a toner image on a recording medium P, retaining the shape of the fixing nip N and quality of the toner image formed on the recording medium P.

Both lateral ends of the stay 125 and the halogen heaters 123A and 123B in a longitudinal direction thereof are secured to and supported by a pair of side plates of the fixing device 120 or a pair of holders, provided separately from the pair of side plates, respectively.

A detailed description is now given of a configuration of the lateral end heaters 126.

The lateral end heaters 126 are mounted on or coupled with both lateral ends of the nip formation pad 124 in the longitudinal direction thereof, respectively. The lateral end heaters 126 serve as a sub heater provided separately from the main heater or the fixing heater (e.g., the halogen heaters 123A and 123B). The lateral end heaters 126 heat both lateral ends of the fixing belt 121 in the axial direction thereof, respectively. The lateral end heater 126 is a contact heater that contacts the fixing belt 121 to conduct heat to the fixing belt 121, for example, a resistive heat generator such as a ceramic heater.

A detailed description is now given of a configuration of the thermal conduction aid 127.

The thermal conduction aid 127 also serves as a thermal equalizer that facilitates conduction of heat in the axial direction of the fixing belt 121. The thermal conduction aid 127 covers a nip-side face of each of the nip formation pad 124 and the lateral end heaters 126, which is disposed opposite an inner circumferential surface of the fixing belt 121. The thermal conduction aid 127 initiatively conducts and equalizes heat in the fixing belt 121 in a longitudinal direction of the thermal conduction aid 127 that is parallel to the axial direction of the fixing belt 121, preventing heat from being stored at both lateral ends of the fixing belt 121 in the axial direction thereof while a plurality of small recording media P is conveyed over the fixing belt 121 or while the lateral end heaters 126 are turned on. Thus, the thermal conduction aid 127 eliminates uneven temperature of the fixing belt 121 in the axial direction thereof. Hence, the thermal conduction aid 127 is made of a material that conducts heat quickly, for example, a material having an enhanced thermal conductivity such as copper having a thermal conductivity of 398 W/mk and aluminum having a thermal conductivity of 236 W/mk.

The thermal conduction aid 127 includes a nip-side face 127*a* being disposed opposite and in direct contact with the inner circumferential surface of the fixing belt 121, thus serving as a nip formation face that forms the fixing nip N. As illustrated in FIG. 18, the nip-side face 127*a* is planar. Alternatively, the nip-side face 127*a* may be curved or recessed or may have other shapes. If the nip-side face 127*a* is recessed with respect to the pressure roller 122, the nip-side face 127*a* directs a leading edge of the recording medium P toward the pressure roller 122 as the recording medium P is ejected from the fixing nip N, facilitating separation of the recording medium P from the fixing belt 121 and suppressing jamming of the recording medium P between the fixing belt 121 and the pressure roller 122.

A temperature sensor 129 is disposed opposite the outer circumferential surface of the fixing belt 121 at a proper position thereon, for example, a position upstream from the fixing nip N in the rotation direction D121 of the fixing belt 121. The temperature sensor 129 detects a temperature of the fixing belt 121. A separator 141 is disposed downstream from the fixing nip N in the recording medium conveyance direction A1 to separate the recording medium P from the fixing belt 121. A pressurization assembly, that is equivalent to the switcher 60 depicted in FIGS. 7A and 7B, presses the pressure roller 122 against the nip formation pad 124 via the fixing belt 121 and releases pressure exerted by the pressure roller 122 to the fixing belt 121.

Like film, the fixing belt 121 is a thin, endless belt having a decreased loop diameter to achieve a decreased thermal capacity. Since the fixing belt 121 has a construction similar to the above-described construction of the fixing belt 21 depicted in FIG. 2, a description of the fixing belt 121 is omitted.

A detailed description is now given of a construction of the stay 125.

The stay 125, having a T-shape in cross-section, includes a base 125*b* disposed opposite the fixing nip N and an arm 125*a* projecting from the base 125*b* and being disposed opposite the nip formation pad 124 via the base 125*b*. The arm 125*a* is interposed between the halogen heaters 123A and 123B serving as the main heater to screen the halogen heater 123A from the halogen heater 123B.

A detailed description is now given of a construction of the halogen heaters 123A and 123B.

The halogen heater 123A includes a center heat generator disposed in a center span of the halogen heater 123A in the longitudinal direction thereof. A small recording medium P is disposed opposite the center heat generator of the halogen heater 123A. The halogen heater 123B includes a lateral end heat generator disposed in each lateral end span of the halogen heater 123B in the longitudinal direction thereof. A large recording medium P is disposed opposite the lateral end heat generator of the halogen heater 123B. The power supply situated inside the image forming apparatus 1 supplies power to the halogen heaters 123A and 123B so that the halogen heaters 123A and 123B generate heat. The controller 90 operatively connected to the halogen heaters 123A and 123B and the temperature sensor 129 controls the halogen heaters 123A and 123B based on the temperature of the outer circumferential surface of the fixing belt 121, which is detected by the temperature sensor 129 disposed opposite the outer circumferential surface of the fixing belt 121. Thus, the temperature of the fixing belt 121 is adjusted to a desired fixing temperature.

A detailed description is now given of a configuration of the reflectors 128A and 128B.

The reflector 128A is interposed between the halogen heater 123A and the stay 125. The reflector 128B is interposed between the halogen heater 123B and the stay 125. The reflectors 128A and 128B reflect light and heat radiated from the halogen heaters 123A and 123B to the reflectors 128A and 128B, respectively, toward the fixing belt 121, thus enhancing heating efficiency of the halogen heaters 123A and 123B to heat the fixing belt 121. Additionally, the reflectors 128A and 128B prevent light and heat radiated from the halogen heaters 123A and 123B from heating the stay 125 with radiant heat, suppressing waste of energy. Alternatively, instead of the reflectors 128A and 128B, an opposed face of the stay 125 disposed opposite the halogen heaters 123A and 123B may be treated with insulation or mirror finish to reflect light and heat radiated from the halogen heaters 123A and 123B to the stay 125 toward the fixing belt 121.

The pressure roller 122 has a construction similar to the above-described construction of the pressure roller 22 depicted in FIG. 2. Further, the fixing device 120 has a configuration that attains a driving force transmission method or the like in which the pressure roller 122 transmits a driving force that drives and rotates the fixing belt 121 to the fixing belt 121, which is similar to the above-described configuration of the fixing device 20 depicted in FIG. 2. Hence, a description of the construction of the pressure roller 122 and the configuration of the fixing device 120 that attains the driving force transmission method is omitted.

Figure 19:
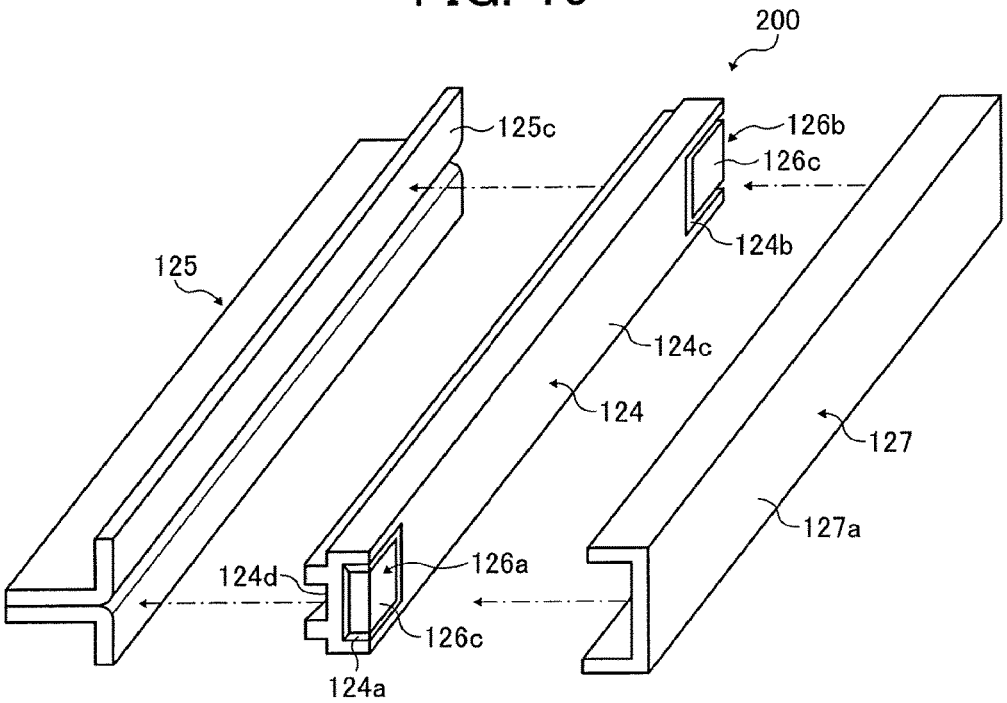
FIG. 19 is an exploded perspective view of a nip formation unit incorporated in the fixing device depicted in FIG. 18.

Referring to FIG. 19, a description is provided of a construction of a nip formation unit 200 incorporated in the fixing device 120 depicted in FIG. 18.

FIG. 19 is an exploded perspective view of the nip formation unit 200, illustrating a basic structure of the nip formation unit 200. As illustrated in FIG. 19, the nip formation unit 200 includes the nip formation pad 124, the stay 125, the thermal conduction aid 127, and lateral end heaters 126*a* and 126*b* illustrated as the lateral end heaters 126 in FIG. 18. Each of the lateral end heaters 126*a* and 126*b* includes a nip-side face 126*c* serving as an opposed face disposed opposite the fixing nip N and the inner circumferential surface of the fixing belt 121. The nip formation pad 124 includes a nip-side face 124*c* serving as an opposed face disposed opposite the fixing nip N and the inner circumferential surface of the fixing belt 121 and a stay-side face 124*d* being opposite the nip-side face 124*c* and disposed opposite the stay 125. The stay 125 includes a nip-side face 125*c* being planar and disposed opposite the fixing nip N and the inner circumferential surface of the fixing belt 121. The stay-side face 124*d* of the nip formation pad 124 contacts the nip-side face 125*c* of the stay 125. For example, the stay-side face 124*d* of the nip formation pad 124 and the nip-side face 125*c* of the stay 125 mount a recess and a projection (e.g., a boss and a pin), respectively, so that the stay-side face 124*d* engages the nip-side face 125*c* to restrict each other with the shape of the stay-side face 124*d* and the nip-side face 125*c*.

The thermal conduction aid 127 engages the nip formation pad 124 that is substantially rectangular such that the thermal conduction aid 127 covers the nip-side face 124*c* of the nip formation pad 124 that is disposed opposite the inner circumferential surface of the fixing belt 21. Thus, the thermal conduction aid 127 is coupled with the nip formation pad 124. For example, the thermal conduction aid 127 is coupled with the nip formation pad 124 with a claw, an adhesive, or the like.

Two recesses 124*a* and 124*b*, each of which defines a step or a difference in thickness of the nip formation pad 124, are disposed at both lateral ends of the nip formation pad 124 in the longitudinal direction thereof, respectively. The lateral end heaters 126*a* and 126*b* are secured to the recesses 124*a* and 124*b*, thus being accommodated by the recesses 124*a* and 124*b*, respectively. A description of a positional relation between the lateral end heaters 126*a* and 126*b* and the halogen heaters 123A and 123B is deferred.

The thermal conduction aid 127 includes the nip-side face 127*a* that is disposed opposite the inner circumferential surface of the fixing belt 21. The nip-side face 127*a* serves as a slide face over which the fixing belt 121 slides. However, since a mechanical strength of the nip-side face 124*c* of the nip formation pad 124 is greater than a mechanical strength of the nip-side face 127*a* of the thermal conduction aid 127, the nip-side face 124*c* of the nip formation pad 124 serves as a nip formation face that is disposed opposite the pressure roller 122 and forms the fixing nip N practically.

According to this embodiment, the lateral end heaters 126*a* and 126*b* are coupled with the nip formation pad 124 to form the fixing nip N. Hence, the lateral end heaters 126*a* and 126*b* are situated inside a limited space inside the loop formed by the fixing belt 121, saving space.

Each of the lateral end heaters 126*a* and 126*b* includes a nip-side face 126*c* disposed opposite the inner circumferential surface of the fixing belt 121. The nip-side face 126*c* of each of the lateral end heaters 126*a* and 126*b* is leveled with the nip-side face 124*c* of the nip formation pad 124 that is disposed opposite the inner circumferential surface of the fixing belt 121 in a pressurization direction in which the pressure roller 122 presses against the nip formation pad 124 so that the nip-side faces 126*c* and the nip-side face 124*c* define an identical plane. Accordingly, the pressure roller 122 is pressed against the lateral end heaters 126*a* and 126*b* via the fixing belt 121 and the thermal conduction aid 127 sufficiently.

Consequently, the fixing belt 121 rotates stably in a state in which the fixing belt 121 is pressed against the lateral end heaters 126*a* and 126*b* or adhered to the lateral end heaters 126*a* and 126*b* indirectly via the thermal conduction aid 127. The fixing belt 121 is pressed against the lateral end heaters 126*a* and 126*b* with sufficient pressure, retaining improved heating efficiency of the lateral end heaters 126*a* and 126*b*. Hence, the fixing device 120 enhances reliability.

The lateral end heaters 126*a* and 126*b* are disposed opposite the fixing nip N. Accordingly, the lateral end heaters 126*a* and 126*b* heat the fixing belt 121 in a nip span of the fixing nip N in the rotation direction D121 of the fixing belt 121. That is, the lateral end heaters 126*a* and 126*b* do not heat the fixing belt 121 in a circumferential span outboard from the nip span in the rotation direction D121 of the fixing belt 121. Hence, the lateral end heaters 126*a* and 126*b* prevent residual toner failed to be fixed on a previous recording medium P and therefore adhering to the fixing belt 121 from being melted again and degrading a toner image on a subsequent recording medium P.

Figure 20:
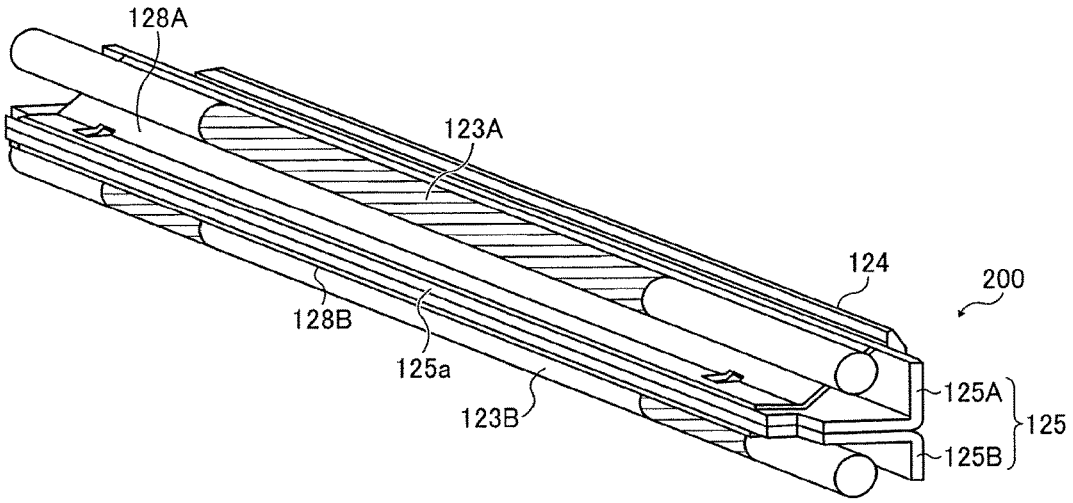
FIG. 20 is a perspective view of the nip formation unit depicted in FIG. 19.

FIG. 20 is a perspective view of the nip formation unit 200 and the halogen heaters 123A and 123B. As illustrated in FIG. 20, the stay 125 includes a first portion 125A and a second portion 125B, each of which is substantially L-shaped in cross-section. Thus, the stay 125 is substantially T-shaped in cross-section. Accordingly, the stay 125 attains an enhanced rigidity that prevents the nip formation pad 124 from being bent by pressure from the pressure roller 122. The stay 125 constructed of the first portion 125A and the second portion 125B extends linearly in the longitudinal direction of the nip formation pad 124. The stay 125 is secured to the nip formation pad 124. Accordingly, the stay 125 allows the nip-side face 124*c* depicted in FIG. 19 of the nip formation pad 124 to retain the fixing nip N precisely throughout the entire width of the fixing nip N in the longitudinal direction of the nip formation pad 124.

As illustrated in FIG. 20, the halogen heater 123A is disposed opposite the halogen heater 123B via the arm 125*a* of the stay 125 in a short direction perpendicular to the longitudinal direction of the stay 125. The arm 125*a* is interposed between the halogen heaters 123A and 123B to screen the halogen heater 123A from the halogen heater 123B. Accordingly, while the halogen heaters 123A and 123B are powered on, glass tubes of the halogen heaters 123A and 123B, respectively, do not heat each other, preventing degradation in heating efficiency of the halogen heaters 123A and 123B.

As illustrated in FIG. 18, each of the halogen heaters 123A and 123B is not surrounded by the stay 125. For example, a center of each of the halogen heaters 123A and 123B in cross-section is outside a space defined or enclosed by the stay 125. Accordingly, the halogen heaters 123A and 123B attain obtuse irradiation angles $\alpha$ and $\beta$, respectively, of light that irradiates the fixing belt 121, thus improving heating efficiency.

Alternatively, the stay 125 may have shapes other than the substantially T-shape in cross-section. The first portion 125A and the second portion 125B depicted in FIG. 20 may curve and extend in the longitudinal direction of the halogen heaters 123A and 123B as long as the arm 125*a* interposed between the halogen heaters 123A and 123B screens the halogen heater 123A from the halogen heater 123B. The arm 125*a* of each of the first portion 125A and the second portion 125B may be oblique relative to the nip-side face 124*c* of the nip formation pad 124.

A description is provided of arrangement of the lateral end heaters 126*a* and 126*b* to correspond to recording media P of special sizes such as an A3 extension size sheet.

Figure 21:
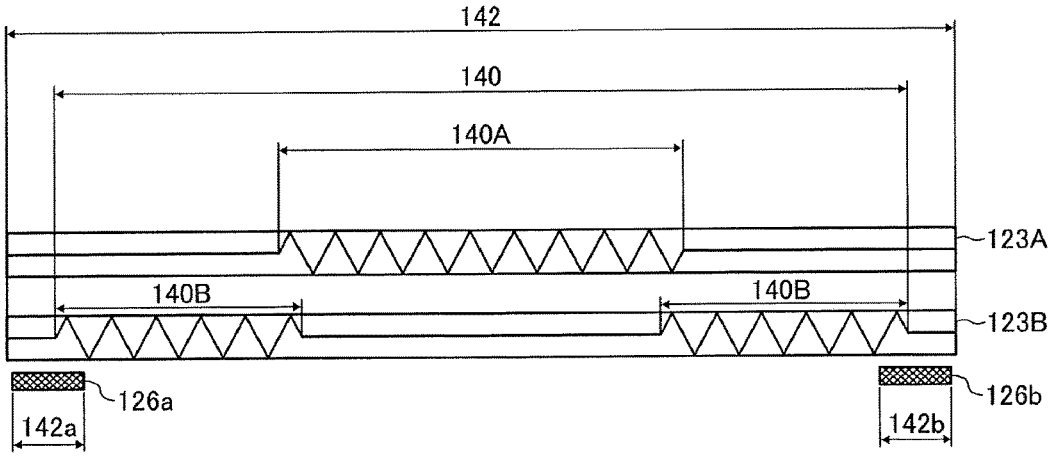
FIG. 21 is a diagram of a plurality of halogen heaters and the plurality of lateral end heaters incorporated in the fixing device depicted in FIG. 18.

FIG. 21 is a diagram of the halogen heaters 123A and 123B and the lateral end heaters 126*a* and 126*b*, illustrating arrangement thereof. As illustrated in FIG. 21, the halogen heater 123A includes a heat generator 140A serving as a center heat generator having a dense light distribution in the center span of the halogen heater 123A, which is disposed opposite a center span of the fixing belt 121 in the axial direction thereof. The halogen heater 123B includes a heat generator 140B serving as a lateral end heat generator having a dense light distribution in each lateral end span of the halogen heater 123B, which is disposed opposite each lateral end span of the fixing belt 121 in the axial direction thereof. The heat generator 140B is disposed outboard from the heat generator 140A in the axial direction of the fixing belt 121. The halogen heater 123A heats the center span of the fixing belt 121 in the axial direction thereof. The halogen heater 123B heats each lateral end span of the fixing belt 121 in the axial direction thereof.

The heat generator 140A of the halogen heater 123A corresponds to small recording media P of small sizes such as an A4 size sheet in portrait orientation. The heat generator 140B of the halogen heater 123B corresponds to large recording media P of large sizes such as an A3 size sheet in portrait orientation. The heat generator 140B is disposed outboard from the heat generator 140A in the longitudinal direction of the halogen heater 123A so that the heat generator 140B heats a lateral end of the large recording medium P that is outboard from the heat generator 140A in the longitudinal direction of the halogen heater 123B. The large recording media P include a maximum standard size sheet available in the fixing device 120. A heat generator 140, that is, a first combined heat generator constructed of or defined by the heat generators 140A and 140B, corresponds to a width of the maximum standard size sheet (e.g., the A3 size sheet in portrait orientation) and does not encompass a width of an extra-large recording medium P of an extension size, which is greater than the width of the maximum standard size sheet.

The lateral end heaters 126*a* and 126*b* are disposed opposite both lateral ends of the halogen heater 123B in the longitudinal direction thereof, respectively. The lateral end heaters 126*a* and 126*b* include heat generators 142*a* and 142*b* that heat both lateral ends of the extra-large recording medium P greater than the maximum standard size sheet in the longitudinal direction of the halogen heater 123B, respectively. Thus, a heat generator 142, that is, a second combined heat generator constructed of or defined by the heat generators 140A, 140B, 142*a*, and 142*b*, corresponds to the width of the extra-large recording medium P of the extension size (e.g., an A3 extension size sheet and a 13-inch sheet). A part of each of the heat generators 142*a* and 142*b* overlaps the heat generator 140B in the longitudinal direction of the halogen heater 123B. Accordingly, the fixing belt 121 of the fixing device 120 heats both lateral ends of the extra-large recording medium P greater than the maximum standard size sheet in the longitudinal direction of the halogen heater 123B.

As illustrated in FIG. 19, the thermal conduction aid 127 covers the nip-side face 124*c* of the nip formation pad 124 and the nip-side face 126*c* of each of the lateral end heaters 126*a* and 126*b*, which are disposed opposite the inner circumferential surface of the fixing belt 121 via the thermal conduction aid 127. The thermal conduction aid 127 is made of a material having an increased thermal conductivity, such as copper and aluminum. Accordingly, even if the lateral end heaters 126*a* and 126*b* are turned off immediately when a failure occurs, the thermal conduction aid 127 may retain a high temperature for a predetermined time due to overshooting or the like. Consequently, when the fixing belt 121 interrupts rotation, the fixing belt 121 may suffer from temperature irregularity and deformation.

Even if the image forming apparatus 1 employs the fixing device 120 configured to save energy substantially, since the controller 90 employs the control to rotate the fixing belt 121 forward or backward as described above, when the failure occurs in the image forming apparatus 1, the controller 90 stops the fixing device 120 and the image forming apparatus 1 quickly, reducing damage to the components of the image forming apparatus 1. Additionally, the controller 90 prevents temperature irregularity and deformation of the fixing belt 121.

The present disclosure is not limited to the details of the embodiments described above and various modifications and improvements are possible. An aspect that the controller 90 determines that the fixing belt 21 or 121 and the pressure roller 22 or 122 at the fixing nip N and at least one of the plurality of rotary bodies sandwich a single recording medium P, that is, an identical recording medium P, simultaneously when a failure occurs is not limited to the embodiments described above as long as the controller 90 determines that the fixing belt 21 or 121 and the pressure roller 22 or 122 at the fixing nip N and at least one of the plurality of rotary bodies sandwich the single recording medium P simultaneously.

A description is provided of advantages of the fixing devices 20 and 120.

As illustrated in FIGS. 1, 2, and 18, a fixing device (e.g., the fixing devices 20 and 120) includes a fixing rotator (e.g., the fixing belts 21 and 121), a heater (e.g., the halogen heaters 23, 123A, and 123B), an opposed rotator (e.g., the pressure rollers 22 and 122), at least one rotary body (e.g., the feed roller 11, the timing roller pair 12, the secondary transfer roller 36, and the secondary transfer backup roller 32), and a controller (e.g., the controller 90).

The fixing rotator is rotatable in a forward direction and a backward direction opposite the forward direction. The heater heats the fixing rotator. The opposed rotator presses against or contacts an outer circumferential surface of the fixing rotator to form a fixing nip (e.g., the fixing nip N) therebetween, through which a recording medium (e.g., a recording medium P) bearing a toner image (e.g., a toner image T) is conveyed. The at least one rotary body conveys the recording medium to the fixing nip. The controller rotates the fixing rotator in the forward direction to fix the toner image on the recording medium. The controller stops the heater and then rotates the fixing rotator in a predetermined rotation direction when a failure occurs while the fixing device is activated. If the fixing rotator and the opposed rotator at the fixing nip and the at least one rotary body sandwich the identical recording medium simultaneously when the failure occurs while the fixing device is activated, the controller determines that the predetermined rotation direction of the fixing rotator is one of the forward direction and the backward direction according to the at least one rotary body that sandwiches the recording medium.

Accordingly, the fixing device prevents overheating of the fixing rotator while the fixing rotator does not rotate with no damage to the components of the fixing device.

As illustrated in FIG. 21, the fixing device 120 employs a center conveyance system in which the recording medium P is centered on the fixing belt 121 in the axial direction thereof. Alternatively, the fixing device 120 may employ a lateral end conveyance system in which the recording medium P is conveyed in the recording medium conveyance direction D121 along one lateral end of the fixing belt 121 in the axial direction thereof. In this case, one of the lateral end heaters 126*a* and 126*b* is eliminated. Another one of the lateral end heaters 126*a* and 126*b* is distal from the one lateral end of the fixing belt 121 in the axial direction thereof. Similarly, the fixing device 20 may employ the lateral end conveyance system.

According to the embodiments described above, each of the fixing belts 21 and 121 serves as a fixing rotator. Alternatively, a fixing film or the like may be used as a fixing rotator. Further, each of the pressure rollers 22 and 122 serves as an opposed rotator. Alternatively, a pressure belt or the like may be used as an opposed rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. An image forming apparatus comprising:

a fixing device to fix a toner image on a recording medium, the fixing device including:

a fixing rotator being rotatable in a forward direction and a backward direction opposite the forward direction;

a heater to heat the fixing rotator; and an opposed rotator to press against an outer circumferential surface of the fixing rotator to form a fixing nip between the fixing rotator and the opposed rotator, the fixing nip through which the recording medium bearing the toner image is conveyed;

at least one rotary body to convey the recording medium to the fixing nip;

a rotation load detector to detect a rotation load imposed on the fixing rotator;

and a controller to rotate the fixing rotator in the forward direction to fix the toner image on the recording medium, the controller to stop the heater and rotate the fixing rotator in a predetermined rotation direction when a failure occurs while the fixing rotator and the opposed rotator at the fixing nip and the at least one rotary body sandwich the recording medium simultaneously when the failure occurs while the fixing device is activated, the controller to determine that the predetermined rotation direction of the fixing rotator is the backward direction if the rotation load imposed on the fixing rotator detected by the rotation load detector is a predetermined value or greater when the failure occurs while the fixing device is activated, and the controller to determine that the predetermined rotation direction of the fixing rotator is the forward direction if the rotation load imposed on the fixing rotator detected by the rotation load detector is less than the predetermined value when the failure occurs while the fixing device is activated.

2. The image forming apparatus according to claim 1, wherein the fixing device further includes:

a nip formation pad to form the fixing nip, the nip formation pad including an opposed face disposed opposite an inner circumferential surface of the fixing rotator;

a contact heater, disposed at a lateral end of the nip formation pad in a longitudinal direction of the nip formation pad, to heat a lateral end of the fixing rotator in an axial direction of the fixing rotator, the contact heater including an opposed face disposed opposite the inner circumferential surface of the fixing rotator; and a thermal conduction aid, covering the opposed face of each of the nip formation pad and the contact heater, to conduct heat in the axial direction of the fixing rotator.

3. The image forming apparatus according to claim 2, wherein the fixing device further includes another contact heater, disposed at another lateral end of the nip formation pad in the longitudinal direction of the nip formation pad, to heat another lateral end of the fixing rotator in the axial direction of the fixing rotator.

4. The image forming apparatus according to claim 1, further comprising at least one recording medium detector to detect presence of the recording medium, wherein the controller rotates the fixing rotator in the backward direction if the at least one recording medium detector detects presence of the recording medium when the failure occurs while the fixing device is activated.

5. The image forming apparatus according to claim 4, further comprising a sheet tray to load the recording medium, wherein the at least one rotary body includes:

a feed roller to feed the recording medium from the sheet tray;

a timing roller pair to convey the recording medium fed by the feed roller;

a secondary transfer roller to convey the recording medium conveyed by the timing roller pair; and a secondary transfer backup roller disposed opposite the secondary transfer roller.

6. The image forming apparatus according to claim 5, wherein the at least one recording medium detector includes:

a sheet tray downstream sensor disposed downstream from the feed roller in a recording medium conveyance direction;

a timing roller pair upstream sensor disposed upstream from the timing roller pair in the recording medium conveyance direction;

a timing roller pair downstream sensor disposed downstream from the timing roller pair in the recording medium conveyance direction; and a fixing device upstream sensor disposed upstream from the fixing device in the recording medium conveyance direction.

7. The image forming apparatus according to claim 5, wherein a first conveyance force of the fixing rotator to convey the recording medium is smaller than a second conveyance force of the timing roller pair to convey the recording medium.

8. The image forming apparatus according to claim 7, wherein the first conveyance force of the fixing rotator to convey the recording medium is greater than a third conveyance force of the secondary transfer roller to convey the recording medium.

9. The image forming apparatus according to claim 4, further comprising a bypass tray to load the recording medium, wherein the at least one recording medium detector includes a bypass tray downstream sensor disposed downstream from the bypass tray in a recording medium conveyance direction.

10. The image forming apparatus according to claim 1, wherein the fixing device further includes a speed detector to detect a rotation speed of the fixing rotator, and wherein the controller rotates the fixing rotator in the backward direction if the rotation speed of the fixing rotator that is detected by the speed detector is a predetermined speed or lower when the failure occurs while the fixing device is activated.

11. The image forming apparatus according to claim 10, wherein the speed detector includes a reflection sensor, disposed in proximity to the fixing rotator, to detect change in a reflectance that generates in accordance with rotation of the fixing rotator.

12. The image forming apparatus according to claim 11, wherein the fixing device further includes a plurality of markings disposed on one lateral end of the fixing rotator in an axial direction of the fixing rotator, the plurality of markings having a reflectance that is different from a reflectance of the outer circumferential surface of the fixing rotator.

13. The image forming apparatus according to claim 1, wherein the controller rotates the fixing rotator at a first linear velocity in the forward direction to fix the toner image on the recording medium, and wherein the controller rotates the fixing rotator at a second linear velocity in the backward direction when the failure occurs while the fixing device is activated, the second linear velocity being lower than the first linear velocity.

14. The image forming apparatus according to claim 1, wherein the fixing device further includes a switcher to move the opposed rotator between a pressurization position where the opposed rotator presses against the fixing rotator and a depressurization position where the opposed rotator releases pressure exerted to the fixing rotator, and wherein the controller moves the opposed rotator to the depressurization position after the controller interrupts rotation of the fixing rotator.

15. An image forming method comprising:

detecting that a recording medium is jammed;

turning off a heater;

starting rotating a fixing rotator at a second linear velocity lower than a first linear velocity at which the fixing rotator rotates when fixing a toner image;

measuring a fixing rotator driving load imposed on the fixing rotator using a rotation load detector;

determining that the fixing rotator driving load measured by the rotation load detector is a predetermined value or greater;

when the fixing rotator driving load is determined to be the predetermined value or greater, braking a fixing motor, interrupting driving of the fixing rotator, and rotating the fixing rotator in a backward direction; and when the fixing rotator driving load is determined to be less than the predetermined value, rotating the fixing rotator in a forward direction at the second linear velocity.

* * * * *